US009335074B2

(12) United States Patent
Yamashita et al.

(10) Patent No.: US 9,335,074 B2
(45) Date of Patent: May 10, 2016

(54) AIR-CONDITIONING APPARATUS

(75) Inventors: Koji Yamashita, Tokyo (JP); Hiroyuki Morimoto, Tokyo (JP); Yuji Motomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 870 days.

(21) Appl. No.: 13/501,516

(22) PCT Filed: Oct. 28, 2009

(86) PCT No.: PCT/JP2009/068485

§ 371 (c)(1),
(2), (4) Date: Apr. 12, 2012

(87) PCT Pub. No.: WO2011/052050

PCT Pub. Date: May 5, 2011

(65) Prior Publication Data

US 2012/0198872 A1 Aug. 9, 2012

(51) Int. Cl.

| | |
|---|---|
| ***F25B 7/00*** | (2006.01) |
| ***F25B 25/00*** | (2006.01) |
| ***F25B 13/00*** | (2006.01) |
| *F25B 49/02* | (2006.01) |

(52) U.S. Cl.

CPC ..... *F25B 25/005* (2013.01); *F25B 13/00* (2013.01); *F25B 7/00* (2013.01); *F25B 49/027* (2013.01); *F25B 2313/006* (2013.01); *F25B 2313/0231* (2013.01); *F25B 2313/0272* (2013.01); *F25B 2313/02741* (2013.01); *F25B 2500/221* (2013.01)

(58) Field of Classification Search

CPC ..... F25B 13/00; F25B 7/00; F25B 25/00; F25B 30/02; F25B 30/00

USPC ..... 62/159, 175, 185, 180, 335

See application file for complete search history.

(56) References Cited

U.S. PATENT DOCUMENTS

| | | | | |
|---|---|---|---|---|
| 2,202,946 | A * | 6/1940 | Carrier | 165/299 |
| 2,279,657 | A * | 4/1942 | Crawford | 62/157 |
| 2,315,379 | A * | 3/1943 | Robson | 62/95 |

(Continued)

FOREIGN PATENT DOCUMENTS

| | | | |
|---|---|---|---|
| CN | 101490482 | A | 7/2009 |
| JP | 2-085579 | A | 3/1990 |

(Continued)

OTHER PUBLICATIONS

Office Action (Notice of Reasons for Rejection) dated Nov. 19, 2013, issued in corresponding Japanese Patent Application No. 2011-538151, and an English Translation of the Office Action. (7 pages).

(Continued)

*Primary Examiner* — Ljiljana Ciric
*Assistant Examiner* — Alexis Cox
(74) *Attorney, Agent, or Firm* — Buchanan Ingersoll & Rooney PC

(57) ABSTRACT

An air-conditioning apparatus includes at least a use side heat medium flow control device and a heat medium flow switching device disposed in an outlet side of the heat medium passage of a use side heat exchanger, and a heat medium backflow prevention device disposed in an inlet side of the heat medium passage of a use side heat exchanger.

10 Claims, 10 Drawing Sheets

(56) References Cited

U.S. PATENT DOCUMENTS

| | | | | | |
|---|---|---|---|---|---|
| 2,490,983 | A | * | 12/1949 | Smith et al. | 62/185 |
| 2,797,068 | A | * | 6/1957 | McFarlan | 165/207 |
| 3,520,146 | A | * | 7/1970 | Arnold, Sr. | 62/115 |
| 3,527,059 | A | * | 9/1970 | Rust et al. | 62/115 |
| 3,670,806 | A | * | 6/1972 | McFarlan | 165/210 |
| 4,210,957 | A | * | 7/1980 | Spethmann | 700/276 |
| 4,393,662 | A | * | 7/1983 | Dirth | 62/115 |
| 4,463,574 | A | * | 8/1984 | Spethmann et al. | 62/175 |
| 4,485,639 | A | * | 12/1984 | Sakamoto | 62/505 |
| 4,495,777 | A | * | 1/1985 | Babington | 62/185 |
| 4,817,574 | A | * | 4/1989 | Engel et al. | 123/494 |
| 6,212,895 | B1 | * | 4/2001 | Richardson | 62/185 |
| 6,237,358 | B1 | * | 5/2001 | Kondo et al. | 62/335 |
| 6,298,685 | B1 | * | 10/2001 | Tepman | 62/378 |
| 6,393,858 | B1 | * | 5/2002 | Mezaki et al. | 62/335 |
| 9,046,283 | B2 | * | 6/2015 | Morimoto | F25B 13/00 |
| 2006/0065131 | A1 | * | 3/2006 | Taylor | 99/446 |
| 2009/0288437 | A1 | | 11/2009 | Matsuoka et al. | |

FOREIGN PATENT DOCUMENTS

| | | | |
|---|---|---|---|
| JP | 5-280818 | A | 10/1993 |
| JP | 6-337138 | A | 12/1994 |
| JP | 7-091711 | A | 4/1995 |
| JP | 9-303823 | A | 11/1997 |
| JP | 2000-97527 | A | 4/2000 |
| JP | 2001-289465 | A | 10/2001 |
| JP | 2002-098346 | A | 4/2002 |
| JP | 2003-343936 | A | 12/2003 |
| JP | 2005-140444 | A | 6/2005 |
| JP | 2007-113811 | A | 5/2007 |
| WO | WO 9420800 | A1 * | 9/1994 |
| WO | WO 2009100501 | A1 * | 8/2009 |

OTHER PUBLICATIONS

Office Action issued on Aug. 19, 2014, by the Chinese Patent Office in corresponding Chinese Patent Application No. 200980162204.2. (5 pages).

Office Action (Notice of Reasons for Rejection) dated Apr. 23, 2013, issued in corresponding Japanese Patent Application No. 2011-538151, and an English Translation of the Office Action. (6 pages).

International Search Report (PCT/ISA/210) issued on Jan. 26, 2010, by Japanese Patent Office as the International Searching Authority for International Application No. PCT/JP2009/068485.

Office Action (Decision of Refusal) issued on Mar. 18, 2014, by the Japanese Patent Office in corresponding Japanese Patent Application No. 2011-538151, and an English Translation of the Office Action. (2 pages).

Chinese Office Action (Notification of First Office Action) dated Dec. 25, 2013, in corresponding Chinese Patent Application No. 200980162204.2 and English Translation thereof. (10 pgs.).

* cited by examiner

AIR-CONDITIONING APPARATUS

TECHNICAL FIELD

The present invention relates to an air-conditioning apparatus, which is applied to, for example, a multi-air-conditioning apparatus for a building.

BACKGROUND ART

In an air-conditioning apparatus such as a multi-air-conditioning apparatus for a building, a refrigerant is circulated between an outdoor unit, which is a heat source unit disposed, for example, outside a building, and indoor units disposed in rooms in the building. The refrigerant transfers heat or removes heat to heat or cool air, thus heating or cooling a conditioned space through the heated or cooled air. Hydrofluorocarbon (HFC) refrigerants are often used as the refrigerant, for example. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and it is carried to an indoor unit, such as a fan coil unit or a panel heater, to perform heating or cooling (refer to Patent Literature 1, for example).

Moreover, there is an air-conditioning apparatus called a heat recovery chiller that connects a heat source unit to each indoor unit with four water pipes arranged therebetween, supplies cooled and heated water or the like simultaneously, and allows the cooling and heating in the indoor units to be selected freely. (Refer to Patent Literature 2, for example).

In addition, there is an air-conditioning apparatus that disposes a heat exchanger for a primary refrigerant and a secondary refrigerant near each indoor unit in which the secondary refrigerant is carried to the indoor unit (refer to Patent Literature 3, for example).

Furthermore, there is an air-conditioning apparatus that connects an outdoor unit to each branch unit including a heat exchanger with two pipes in which a secondary refrigerant is carried to an indoor unit (refer to Patent Literature 4, for example).

CITATION LIST

Patent Literature

Patent Literature 1: Japanese Unexamined Patent Application Publication No. 2005-140444 (page 4, FIG. 1, etc.)

Patent Literature 2: Japanese Unexamined Patent Application Publication No. 5-280818 (pages 4 and 5, FIG. 1, etc.)

Patent Literature 3: Japanese Unexamined Patent Application Publication No. 2001-289465 (pages 5 to 8, FIG. 1, FIG. 2, etc.)

Patent Literature 4: Japanese Unexamined Patent Application Publication No. 2003-343936 (page 5, FIG. 1)

SUMMARY OF INVENTION

Technical Problem

In an air-conditioning apparatus of a related art, such as a multi-air-conditioning apparatus for a building, there is a possibility of refrigerant leakage to, for example, an indoor space because the refrigerant is circulated to an indoor unit.

On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat transfer medium needs to be heated or cooled in a heat source unit disposed outside a structure, and needs to be carried to the indoor unit side. Accordingly, a circulation path of the heat transfer medium is long. In this case, carrying of heat for a predetermined heating or cooling work using the heat transfer medium consumes more amount of energy, in the form of conveyance power and the like, than the amount of energy consumed by the refrigerant. As the circulation path becomes longer, therefore, the conveyance power becomes markedly large. This indicates that energy saving can be achieved in an air-conditioning apparatus if the circulation of the heat medium can be controlled well.

In the air-conditioning apparatus disclosed in Patent Literature 2, the four pipes connecting the outdoor side and the indoor need to be arranged in order to allow cooling or heating to be selected in each indoor unit. Disadvantageously, there is little ease of construction. In the air-conditioning apparatus disclosed in Patent Literature 3, secondary medium circulating device, such as a pump, needs to be provided for each indoor unit. Disadvantageously, the system is not only costly but also is noisy, and is not practical. In addition, since the heat exchanger is disposed near each indoor unit, the risk of refrigerant leakage to a place near an indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units is connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipes. Accordingly, there is little ease of construction in such a system.

The present invention has been made to overcome the above-described problem, and a first object thereof is to provide an air-conditioning apparatus capable of achieving energy saving. In addition to the first object, in some aspects of the present invention, a second object is to provide an air-conditioning apparatus capable of increasing its safety by not circulating the refrigerant to or near an indoor unit. Further, in addition to the first object and the second object, in some aspects of the present invention, a third object is to provide an air-conditioning apparatus capable of increasing ease of construction and increasing energy efficiency by reducing the connecting piping between an outdoor unit and a branch unit (heat transfer medium relay unit) or the connecting piping between the branch unit and an indoor unit.

Solution to Problem

An air-conditioning apparatus according the invention includes at least: a compressor; a heat source side heat exchanger; a plurality of expansion devices; a plurality of heat exchangers related to heat transfer medium; a pump; and one or more use side heat exchangers, in which a refrigerant circuit circulating a heat source side refrigerant is formed by connecting the compressor, the heat source side heat exchanger, the expansion devices, and refrigerant side passages of the heat exchangers related to heat transfer medium with a refrigerant piping, a heat transfer medium circuit circulating a heat transfer medium is formed by connecting the pump, the one or more use side heat exchangers, and heat transfer medium side passages of the heat exchangers related to heat transfer medium with a heat transfer medium piping, and the heat source side refrigerant and the heat transfer medium exchanges heat in the heat exchangers related to heat transfer medium. The air-conditioning apparatus further includes a use side heat transfer medium flow control device and a first heat transfer medium flow switching device, each disposed in the outlet side of the heat transfer medium passage of the one or more use side heat exchangers; and a heat transfer medium backflow prevention device disposed in the inlet side of the heat transfer medium passage of the one or more use side heat exchangers.

Advantageous Effects of Invention

According to the air-conditioning apparatus of the invention, the pipes in which the heat transfer medium circulates can be shortened and small conveyance power is required, and thus, safety is increased and energy is saved. Furthermore, according to the air-conditioning apparatus of the invention, even if the heat transfer medium should leak out, it will be a small amount. Accordingly, safety is further increased.

DESCRIPTION OF EMBODIMENT

Embodiment of the invention will be described below with reference to the drawings.

Figure 1:
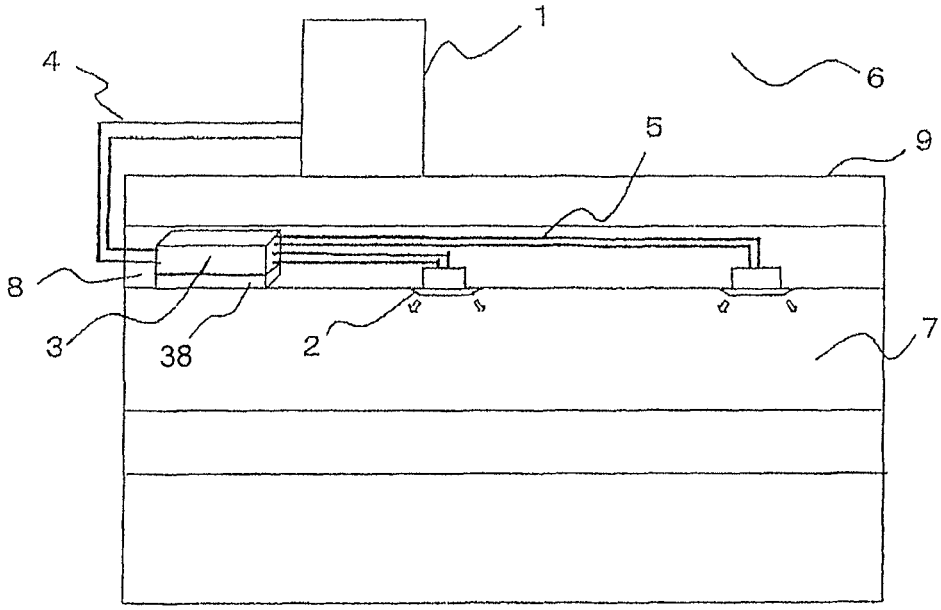
FIG. 1 is a schematic diagram illustrating an exemplary installation of an air-conditioning apparatus according to Embodiment of the invention.
Figure 2:
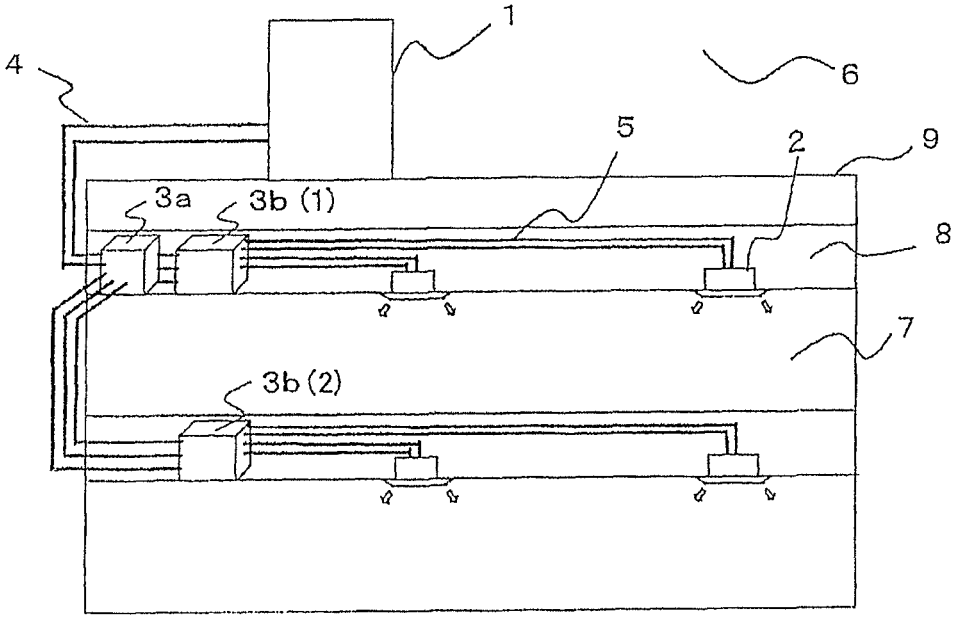
FIG. 2 is a schematic diagram illustrating an exemplary installation of an air-conditioning apparatus according to Embodiment of the invention.

FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. This air-conditioning apparatus uses refrigeration cycles (a refrigerant circuit A and a heat transfer medium circuit B) in which refrigerants (a heat source side refrigerant or a heat transfer medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat transfer medium relay unit 3 disposed between the outdoor unit 1 and the indoor units 2. The heat transfer medium relay unit 3 exchanges heat between the heat source side refrigerant and the heat transfer medium. The outdoor unit 1 and the heat transfer medium relay unit 3 are connected with refrigerant pipes 4 through which the heat source side refrigerant flows. The heat medium relay unit 3 and each indoor unit 2 are connected with pipes (heat transfer medium pipes) through which the heat medium flows. Cooling energy or heating energy generated in the outdoor unit 1 is delivered through the heat transfer medium relay unit 3 to the indoor units 2.

Referring to FIG. 2, the air-conditioning apparatus according to Embodiment includes a single outdoor unit 1, a plurality of indoor units 2, a plurality of separated heat transfer medium relay units 3 (a main heat transfer medium relay unit 3*a* and sub heat transfer medium relay units 3*b*) disposed between the outdoor unit 1 and the indoor units 2. The outdoor unit 1 and the main heat transfer medium relay unit 3*a* are connected with the refrigerant pipes 4. The main heat transfer medium relay unit 3*a* and the sub heat transfer medium relay units 3*b* are connected with the refrigerant pipes 4. Each sub heat transfer medium relay unit 3*b* and each indoor unit 2 are connected with the pipes 5. Cooling energy or heating energy generated in the outdoor unit 1 is delivered through the main heat transfer medium relay unit 3*a* and the sub heat transfer medium relay units 3*b* to the indoor units 2.

The outdoor unit 1 is typically disposed in an outdoor space 6 which is a space (e.g., a roof) outside a structure 9, such as a building, and is configured to supply cooling energy or heating energy through the heat transfer medium relay unit 3 to the indoor units 2. Each indoor unit 2 is disposed at a position that can supply cooling air or heating air to an indoor space 7, which is a space (e.g., a living room) inside the structure 9, and supplies the cooling air or heating air to the indoor space 7, that is, to a conditioned space. The heat transfer medium relay unit 3 is configured with a housing separate from the outdoor unit 1 and the indoor units 2 such that the heat transfer medium relay unit 3 can be disposed at a position different from those of the outdoor space 6 and the indoor space 7, and is connected to the outdoor unit 1 through the refrigerant pipes 4 and is connected to the indoor units 2 through the pipes 5 to convey cooling energy or heating energy, supplied from the outdoor unit 1 to the indoor units 2.

As illustrated in FIGS. 1 and 2, in the air-conditioning apparatus according to Embodiment, the outdoor unit 1 is connected to the heat transfer medium relay unit 3 using two refrigerant pipes 4, and the heat medium relay unit 3 is connected to each indoor unit 2 using two pipes 5. As described above, in the air-conditioning apparatus according to Embodiment, each of the units (the outdoor unit 1, the indoor units 2, and the heat transfer medium relay unit 3) is connected using two pipes (the refrigerant pipes 4 or the pipes 5), thus construction is facilitated.

As illustrated in FIG. 2, the heat transfer medium relay unit 3 can be separated into a single main heat transfer medium relay unit 3*a* and two sub heat transfer medium relay units 3*b* (a sub heat transfer medium relay unit 3*b*(1) and a sub heat transfer medium relay unit 3*b*(2)) derived from the main heat transfer medium relay unit 3*a*. This separation allows a plurality of sub heat transfer medium relay units 3*b* to be connected to the single main heat transfer medium relay unit 3*a*. In this configuration, the number of refrigerant piping 4 connecting the main heat transfer medium relay unit 3*a* to each sub heat transfer medium relay unit 3*b* is three. Regards to this circuit, description will later be made in detail in FIG. 4.

Furthermore, FIGS. 1 and 2 illustrate a state where each heat transfer medium relay unit 3 is disposed in the structure 9 but in a space different from the indoor space 7, for example, a space above a ceiling (hereinafter, simply referred to as a "space 8"). The heat transfer medium relay unit 3 can be disposed in other spaces, e.g., a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat transfer medium relay unit 3 can be disposed near the outdoor unit 1. It should be noted that when the distance from the heat transfer medium relay unit 3 to the indoor unit 2 is excessively long, because power for conveying the heat transfer medium is significantly large, the advantageous effect of energy saving is reduced. Additionally, the numbers of connected outdoor units 1, indoor units 2, and heat transfer medium relay units 3 are not limited to those illustrated in FIGS. 1 and 2. The numbers thereof can be determined in accordance with the structure 9 where the air-conditioning apparatus according to Embodiment is installed.

Figure 3:
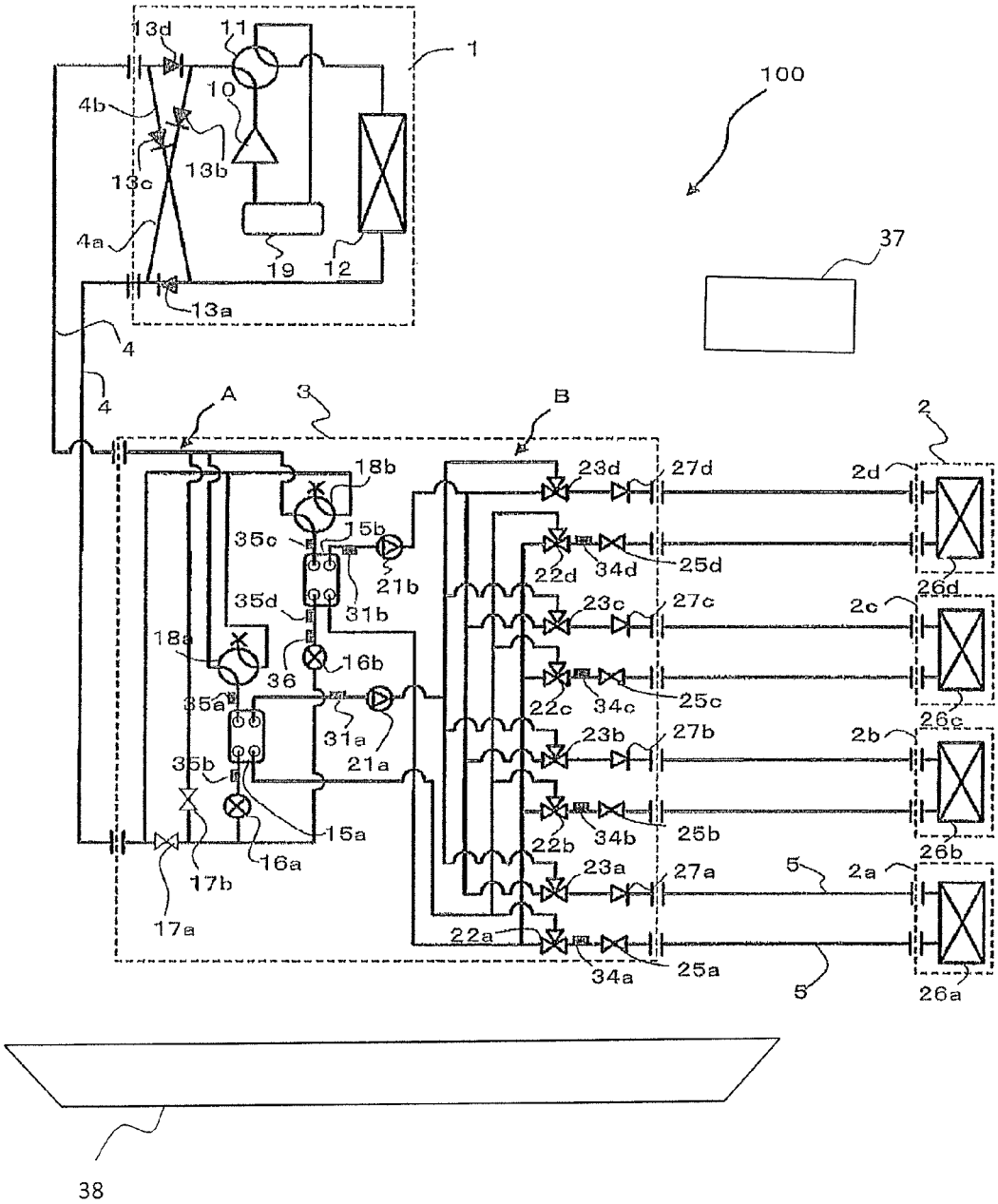
FIG. 3 is a schematic circuit diagram illustrating an exemplary circuit configuration of the air-conditioning apparatus according to Embodiment of the invention.

FIG. 3 is a schematic circuit diagram illustrating an exemplary circuit configuration of the air-conditioning apparatus (hereinafter, referred to as an "air-conditioning apparatus 100") according to Embodiment of the invention. The detailed configuration of the air-conditioning apparatus 100 will be described with reference to FIG. 3. As illustrated in FIG. 3, the outdoor unit 1 and the heat transfer medium relay unit 3 are connected with the refrigerant pipes 4 through heat exchangers related to heat transfer medium 15*a* and 15*b* included in the heat transfer medium relay unit 3. Furthermore, the heat transfer medium relay unit 3 and the indoor units 2 are connected with the pipes 5 through the heat exchangers related to heat transfer medium 15*a* and 15*b*. Note that the refrigerant piping 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipes 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat transfer medium relay unit 3 in a constant direction irrespective of the operation requested by any indoor unit 2.

The compressor 10 sucks the heat source side refrigerant and compress the heat source side refrigerant to a high-temperature, high-pressure state. The compressor 10 may include, for example, a capacity-controllable inverter compressor. The first refrigerant flow switching device 11 switches the flow of the heat source side refrigerant between a heating operation (heating only operation mode and heating main operation mode) and a cooling operation (cooling only operation mode and cooling main operation mode). The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporate and gasify or condense and liquefy the heat source side refrigerant. The accumulator 19 is disposed on the suction side of the compressor 10 and stores excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat transfer medium relay unit 3 to the outdoor unit 1). The check valve 13*a* is provided in the refrigerant piping 4 between the heat source side heat exchanger 12 and the heat transfer medium relay unit 3 and allows the heat source side refrigerant to flow only in a predetermined direction (the direction from the outdoor unit 1 to the heat transfer medium relay unit 3). The check valve 13*b* is provided in the first connecting piping 4*a* and allows the heat source side refrigerant discharged from the compressor 10 to flow through the heat transfer medium relay unit 3 during the heating operation. The check valve 13*c* is disposed in the second connecting piping 4*b* and allows the heat source side refrigerant, returning from the heat transfer medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat transfer medium relay unit 3, in the outdoor unit 1. The second connecting piping 4*b* is configured to connect the refrigerant piping 4, between the check valve 13*d* and the heat transfer medium relay unit 3, to the refrigerant piping 4, between the heat source side heat exchanger 12 and the check valve 13*a*, in the outdoor unit 1. It should be noted that FIG. 3 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they may be omitted.

[Indoor Units 2]

The indoor units 2 each include a use side heat exchanger 26. The use side heat exchanger 26 is connected to a heat transfer medium flow control device 25 and a second heat medium flow switching device 23 in the heat transfer medium relay unit 3 with the pipes 5. Each of the use side heat exchanger 26 exchanges heat between air supplied from an air-sending device, such as a fan, (not illustrated) and the heat transfer medium in order to produce heating air or cooling air to be supplied to the indoor space 7.

FIG. 3 illustrates a case in which four indoor units 2 are connected to the heat transfer medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIGS. 1 and 2, the number of connected indoor units 2 illustrated in FIG. 2 is not limited to four.

[Heat Medium Relay Unit 3]

The heat transfer medium relay unit 3 includes the two heat exchangers related to heat transfer medium 15, two expansion devices 16, two on-off devices 17, two second refrigerant flow switching devices 18, two pumps 21, four first heat transfer medium flow switching devices 22, the four second heat transfer medium flow switching devices 23, the four heat transfer medium flow control devices 25, and four heat transfer medium backflow prevention devices 27. An air-conditioning apparatus in which the heat transfer medium relay unit 3 is separated into the main heat transfer medium relay unit 3*a* and the sub heat transfer medium relay unit 3*b* will be described later with reference to FIG. 4.

Each of the two heat exchangers related to heat transfer medium 15 (the heat exchanger related to heat medium 15*a* and the heat exchanger related to heat transfer medium 15*b*) functions as a condenser (radiator) or an evaporator and exchanges heat between the heat source side refrigerant and the heat transfer medium in order to transfer cooling energy or heating energy, generated in the outdoor unit 1 and stored in the heat source side refrigerant, to the heat transfer medium. The heat exchanger related to heat transfer medium 15*a* is disposed between an expansion device 16*a* and a second refrigerant flow switching device 18*a* in a refrigerant circuit A and is used to cool the heat transfer medium in the cooling and heating mixed operation mode. Additionally, the heat exchanger related to heat transfer medium 15*b* is disposed between an expansion device 16*b* and a second refrigerant flow switching device 18*b* in a refrigerant circuit A and is used to heat the heat transfer medium in the cooling and heating mixed operation mode.

The two expansion devices 16 (the expansion device 16*a* and the expansion device 16*b*) each have functions of a reducing valve and an expansion valve and are configured to reduce the pressure of and expand the heat source side refrigerant. The expansion device 16*a* is disposed upstream of the heat exchanger related to heat transfer medium 15*a*, upstream regarding the heat source side refrigerant flow during the cooling operation. The expansion device 16*b* is disposed upstream of the heat exchanger related to heat transfer medium 15*b*, upstream regarding the heat source side refrigerant flow during the cooling operation. Each of the two expansion devices 16 may include a component having a variably controllable opening degree, e.g., an electronic expansion valve.

The two on-off devices 17 (an on-off device 17*a* and an on-off device 17*b*) each include, for example, a two-way valve and open or close the refrigerant piping 4. The on-off device 17*a* is disposed in the refrigerant piping 4 on the inlet side of the heat source side refrigerant. The opening and closing device 17*b* is disposed in a piping connecting the refrigerant piping 4 on the inlet side of the heat source side refrigerant and the refrigerant piping 4 on an outlet side thereof. The two second refrigerant flow switching devices 18 (second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat transfer medium 15*a*, downstream regarding the heat source side refrigerant flow during the cooling operation. The second refrigerant flow switching device 18*b* is disposed downstream of the heat exchanger related to heat transfer medium 15*b*, downstream regarding the heat source side refrigerant flow during the cooling only operation mode.

The two pumps 21 (pump 21*a* and pump 21*b*) circulate the heat transfer medium flowing through the piping 5. The pump 21*a* is disposed in the piping 5 between the heat exchanger related to heat transfer medium 15*a* and the second heat transfer medium flow switching devices 23. The pump 21*b* is disposed in the piping 5 between the heat exchanger related to heat transfer medium 15*b* and the second heat transfer medium flow switching devices 23. Each of the two pumps 21 may include, for example, a capacity-controllable pump.

The four first heat transfer medium flow switching devices 22 (first heat transfer medium flow switching devices 22*a* to 22*d*) each include, for example, a three-way valve and switch passages of the heat transfer medium. The first heat transfer medium flow switching devices 22 are arranged so that the number thereof (four in this case) corresponds to the installed number of indoor units 1. Each first heat medium flow switching device 22 is disposed on an outlet side of a heat transfer medium passage of the corresponding use side heat exchanger 26 such that one of the three ways is connected to the heat exchanger related to heat transfer medium 15*a*, another one of the three ways is connected to the heat exchanger related to heat transfer medium 15*b*, and the other one of the three ways is connected to the heat medium flow control device 25. Furthermore, illustrated from the bottom of the drawing are the first heat transfer medium flow switching device 22*a*, the first heat medium flow switching device 22*b*, the first heat transfer medium flow switching device 22*c*, and the first heat transfer medium flow switching device 22*d*, so as to correspond to the respective indoor units 2.

The four second heat transfer medium flow switching devices 23 (second heat transfer medium flow switching devices 23*a* to 23*d*) each include, for example, a three-way valve and are configured to switch passages of the heat transfer medium. The second heat transfer medium flow switching devices 23 are arranged so that the number thereof (four in this case) corresponds to the installed number of indoor units 2. Each second heat transfer medium flow switching device 23 is disposed on an inlet side of the heat transfer medium passage of the corresponding use side heat exchanger 26 such that one of the three ways is connected to the heat exchanger related to heat transfer medium 15*a*, another one of the three ways is connected to the heat exchanger related to heat transfer medium 15*b*, and the other one of the three ways is connected to the use side heat exchanger 26. Furthermore, illustrated from the bottom of the drawing are the second heat transfer medium flow switching device 23*a*, the second heat transfer medium flow switching device 23*b*, the second heat transfer medium flow switching device 23*c*, and the second heat transfer medium flow switching device 23*d* so as to correspond to the respective indoor units 2.

The four heat transfer medium flow control devices 25 (heat transfer medium flow control devices 25*a* to 25*d*) each include, for example, a two-way valve capable of controlling the area of opening and controls the flow rate of the heat transfer medium flowing in piping 5. The heat transfer medium flow control devices 25 are arranged so that the number thereof (four in this case) corresponds to the installed number of indoor units 2. Each heat transfer medium flow control device 25 is disposed on the outlet side of the heat transfer medium passage of the corresponding use side heat exchanger 26 such that one way is connected to the use side heat exchanger 26 and the other way is connected to the first heat transfer medium flow switching device 22. Furthermore, illustrated from the bottom of the drawing are the heat transfer medium flow control device 25*a*, the heat transfer medium flow control device 25*b*, the heat transfer medium flow control device 25*c*, and the heat transfer medium flow control device 25*d* so as to correspond to the respective indoor units 2. In addition, each of the heat transfer medium flow control devices 25 may be disposed on the inlet side of the heat transfer medium passage of the corresponding use side heat exchanger 26. Furthermore, each of the heat transfer medium flow control devices 25 functions as a use side heat transfer medium flow control device.

The four heat transfer medium backflow prevention devices 27 (heat transfer medium backflow prevention device 27*a* to 27*d*), each include, as shown in the figure, a check valve or a two-way valve capable of opening and closing the piping 5, for example, and prevents the heat transfer medium flowing from the indoor unit 2 side to the heat transfer medium relay unit 3. The heat transfer medium backflow prevention devices 27 are arranged so that the number thereof (four in this case) corresponds to the installed number of indoor units 2. Each of the heat transfer medium backflow prevention devices 27 is disposed between the corresponding second heat transfer medium flow switching device 23 and use side heat exchanger 26. That is, each of the heat transfer medium backflow prevention devices 27 is disposed on the inlet side of the heat transfer medium passage of the corresponding use side heat exchanger 26. Furthermore, illustrated from the bottom of the drawing are the heat transfer medium backflow prevention device 27*a*, the heat transfer medium backflow prevention device 27*b*, the heat transfer medium backflow prevention device 27*c*, and the heat transfer medium backflow prevention device 27*d* so as to correspond to the respective indoor units 2.

Figure 11:
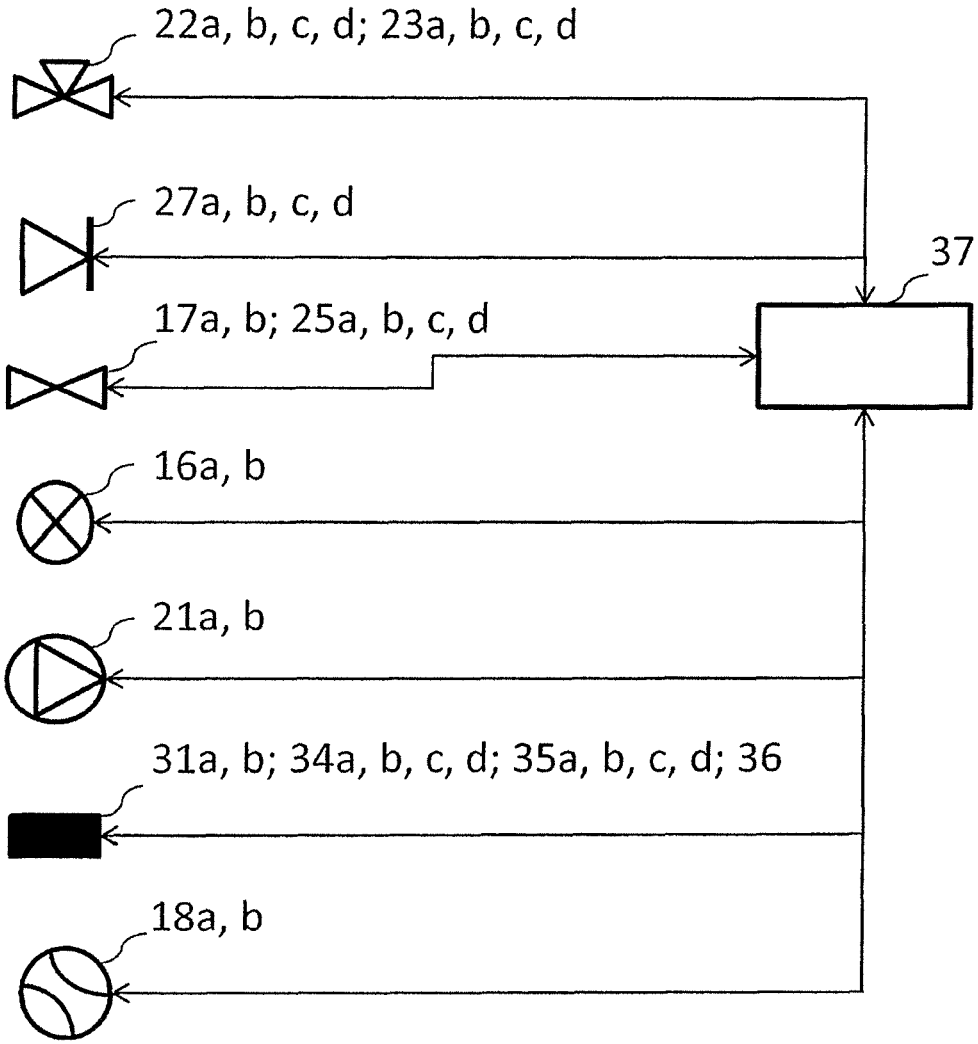
FIG. 11 is a diagram illustrating the various devices in the heat medium relay unit that are connected to the controller.

The heat transfer medium relay unit 3 includes various detectors (two first temperature sensors 31, four second temperature sensors 34, four third temperature sensors 35, and a pressure sensor 36). Information (temperature information and pressure information) detected by these detectors are transmitted to a controller 37 that performs integrated control of the operation of the air-conditioning apparatus 100 such that the information is used to control, for example, the driving frequency of the compressor 10, the rotation speed of the air-blowing device (i.e., a fan) (not illustrated), switching of the first refrigerant flow switching device 11, the driving frequency of the pumps 21, switching by the second refrigerant flow switching devices 18, and switching of passages of the heat transfer medium. See FIG. 11, which shows the various devices in the heat transfer medium relay unit 3 that are connected to the controller 37.

Each of the two first temperature sensors 31 (a first temperature sensor 31*a* and a first temperature sensor 31*b*) detects the temperature of the heat transfer medium flowing out of the heat exchanger related to heat transfer medium 15, namely, the heat transfer medium at an outlet of the heat exchanger related to heat transfer medium 15 and may include, for example, a thermistor. The first temperature sensor 31*a* is disposed in the piping 5 on the inlet side of the pump 21*a*. The first temperature sensor 31*b* is disposed in the piping 5 on the inlet of the pump 21*b*.

Each of the four second temperature sensors 34 (second temperature sensor 34*a* to second temperature sensor 34*d*) is disposed between the first heat transfer medium flow switching device 22 and the heat transfer medium flow control device 25 and detects the temperature of the heat transfer medium flowing out of the use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat transfer medium 15 and detects the temperature of the heat source side refrigerant flowing into the heat exchanger related to heat transfer medium 15, or the temperature of the heat source side refrigerant flowing out of the heat exchanger related to heat transfer medium 15 and may include, for example, a thermistor. The third temperature sensor 35*a* is disposed between the heat exchanger related to heat transfer medium 15*a* and the second refrigerant flow switching device 18*a*. The third temperature sensor 35*b* is disposed between the heat exchanger related to heat transfer medium 15*a* and the expansion device 16*a*. The third temperature sensor 35*c* is disposed between the heat exchanger related to heat transfer medium 15*b* and the second refrigerant flow switching device 18*b*. The third temperature sensor 35*d* is disposed between the heat exchanger related to heat transfer medium 15*b* and the expansion device 16*b*.

The pressure sensor 36 is disposed between the heat exchanger related to heat transfer medium 15*b* and the expansion device 16*b*, similar to the installation position of the third temperature sensor 35*d*, and is configured to detect the pressure of the heat source side refrigerant flowing between the heat exchanger related to heat transfer medium 15*b* and the expansion device 16*b*.

Further, the controller 37 includes, for example, a microcomputer and controls, for example, the driving frequency of the compressor 10, the rotation speed (including ON/OFF) of the air-blowing device, switching of the first refrigerant flow switching device 11, driving of the pumps 21, the opening degree of each expansion device 16, on and off of each on-off device 17, switching of the second refrigerant flow switching devices 18, switching of the first heat transfer medium flow switching devices 22, switching of the second heat transfer medium flow direction switching devices 23, and the driving of each heat transfer medium flow control device 25 on the basis of the information detected by the various detectors and an instruction from a remote control to carry out the operation modes which will be described later. Note that the controller 37 may be provided for each unit, or may be provided for the outdoor unit 1 or the heat medium relay unit 3.

The pipes 5 in which the heat transfer medium flows include the pipes connected to the heat exchanger related to heat transfer medium 15*a* and the pipes connected to the heat exchanger related to heat transfer medium 15*b*. Each piping 5 is branched (into four in this case) in accordance with the number of indoor units 2 connected to the heat transfer medium relay unit 3. The pipes 5 are connected by the first heat transfer medium flow switching devices 22 and the second heat transfer medium flow switching devices 23. Controlling the first heat transfer medium flow switching devices 22 and the second heat transfer medium flow switching devices 23 determines whether the heat transfer medium flowing from the heat exchanger related to heat transfer medium 15*a* is allowed to flow into the use side heat exchanger 26 and whether the heat transfer medium flowing from the heat exchanger related to heat transfer medium 15*b* is allowed to flow into the use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger related to heat transfer medium 15*a*, the expansion devices 16, and the accumulator 19 are connected through the refrigerant piping 4, thus forming the refrigerant circuit A. In addition, a heat transfer medium passage of the heat exchanger related to heat transfer medium 15*a*, the pumps 21, the first heat transfer medium flow switching devices 22, the heat transfer medium flow control devices 25, the use side heat exchangers 26, and the second heat transfer medium flow switching devices 23 are connected through the pipes 5, thus forming the heat transfer medium circuit B. In other words, the plurality of use side heat exchangers 26 are connected in parallel to each of the heat exchangers related to heat transfer medium 15, thus turning the heat transfer medium circuit B into a multi-system.

Accordingly, in the air-conditioning apparatus 100, the outdoor unit 1 and the heat transfer medium relay unit 3 are connected through the heat exchanger related to heat transfer medium 15*a* and the heat exchanger related to heat transfer medium 15*b* arranged in the heat transfer medium relay unit 3. The heat transfer medium relay unit 3 and each indoor unit 2 are connected through the heat exchanger related to heat transfer medium 15*a* and the heat exchanger related to heat transfer medium 15*b*. In other words, in the air-conditioning apparatus 100, the heat exchanger related to heat transfer medium 15*a* and the heat exchanger related to heat transfer medium 15*b* each exchange heat between the heat source side refrigerant circulating in the refrigerant circuit A and the heat transfer medium circulating in the heat transfer medium circuit B.

Figure 4:
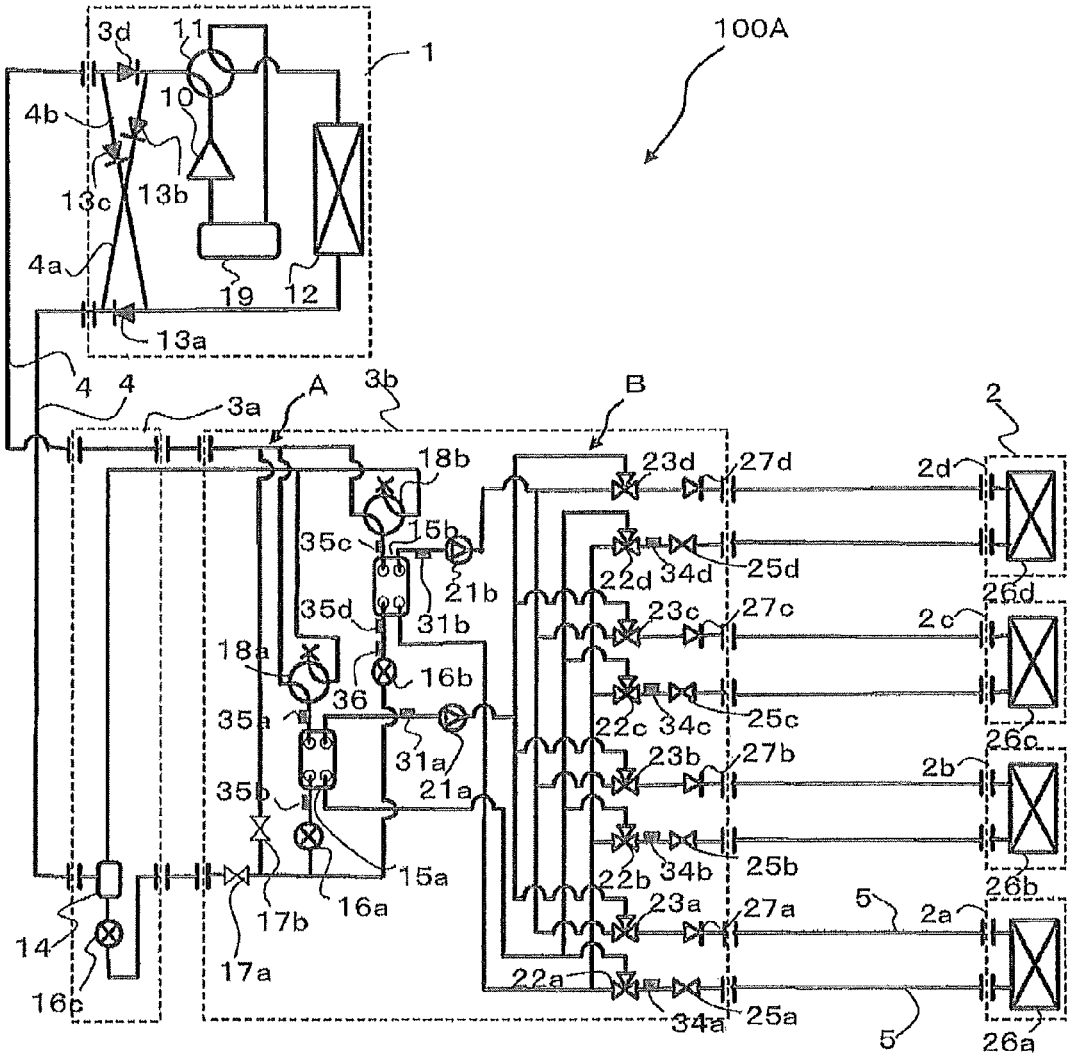
FIG. 4 is another schematic circuit diagram illustrating an exemplary circuit configuration of the air-conditioning apparatus according to Embodiment of the invention.

FIG. 4 is a schematic circuit diagram illustrating an exemplary circuit configuration of the air-conditioning apparatus (hereinafter, referred to as an "air-conditioning apparatus 100A") according to Embodiment of the invention. The circuit configuration of the air-conditioning apparatus 100A in a case in which a heat transfer medium relay unit 4 is separated into a main heat transfer medium relay unit 3*a* and a sub heat transfer medium relay unit 3*b* will be described with reference to FIG. 4. As illustrated in FIG. 4, a housing of the heat transfer medium relay unit 3 is separated such that the heat transfer medium relay unit 3 is composed of the main heat transfer medium relay unit 3*a* and the sub heat transfer medium relay unit 3*b*. This separation allows a plurality of sub heat transfer medium relay units 3*b* to be connected to the single main heat transfer medium relay unit 3*a* as illustrated in FIG. 2.

The main heat transfer medium relay unit 3*a* includes a gas-liquid separator 14 and an expansion device 16*c*. Other components are arranged in the sub heat transfer medium relay unit 3*b*. The gas-liquid separator 14 is connected to a single refrigerant piping 4 connected to an outdoor unit 1 and is connected to two refrigerant pipes 4 connected to a heat exchanger related to heat transfer medium 15*a* and a heat exchanger related to heat transfer medium 15*b* in the sub heat transfer medium relay unit 3*b*, and is configured to separate heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and reduces the pressure of and expands the heat source side refrigerant. During a cooling and heating mixed operation, the expansion device 16*c* is controlled such that the pressure in an outlet of the expansion device 16*c* is at a medium state. The expansion device 16*c* may include a component having a variably controllable opening degree, such as an electronic expansion valve. This arrangement allows a plurality of sub heat transfer medium relay units 3*b* to be connected to the main heat transfer medium relay unit 3*a*.

Various operation modes executed by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat transfer medium.

[Cooling Only Operation Mode]

Figure 5:
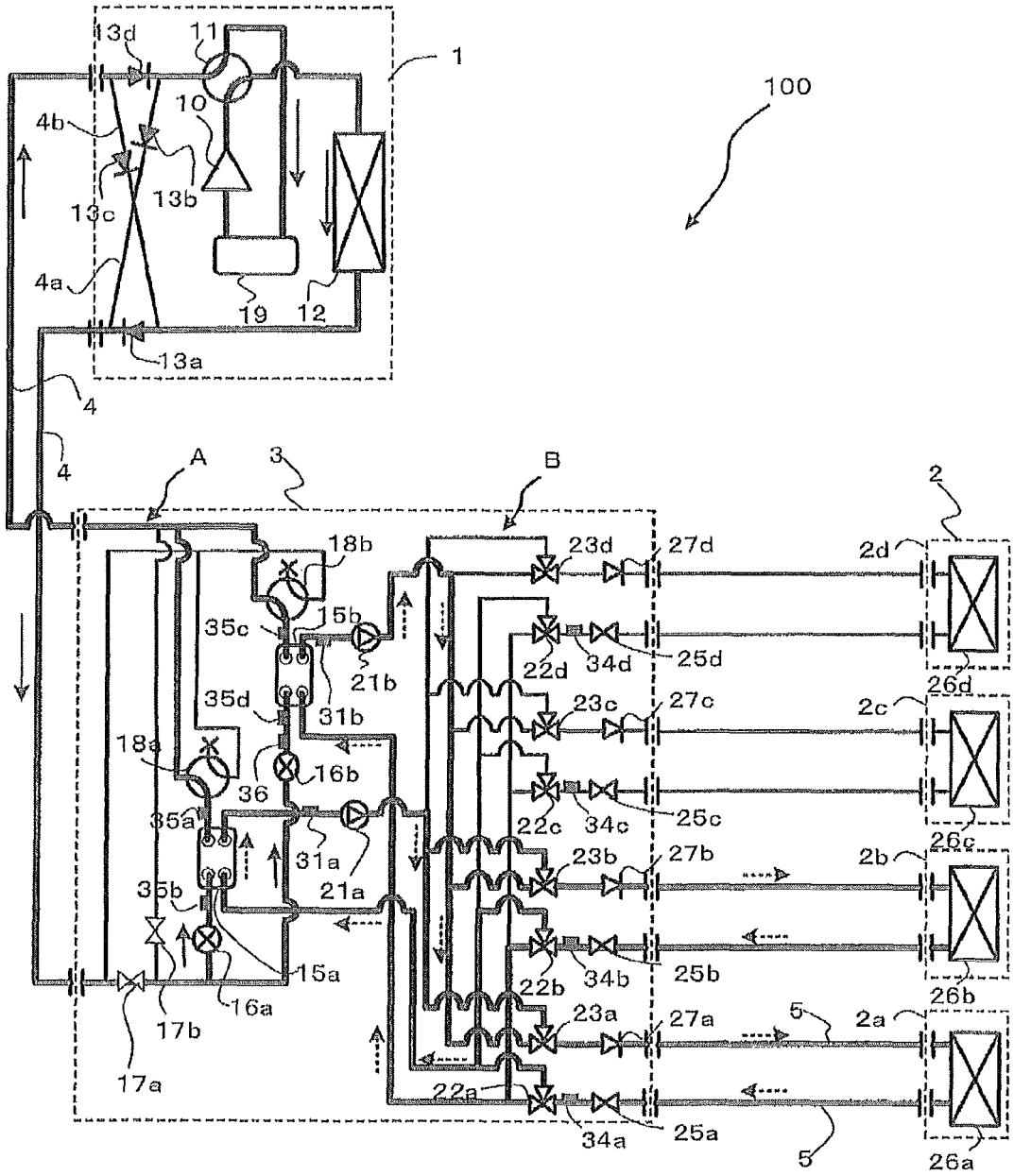
FIG. 5 is a refrigerant circuit diagram illustrating flows of refrigerants in a cooling only operation mode of the air-conditioning apparatus according to Embodiment of the invention.

FIG. 5 is a refrigerant circuit diagram illustrating the flows of refrigerants in the cooling only operation mode of the air-conditioning apparatus 100. The cooling only operation mode will be described with respect to a case in which a cooling load is generated only in a use side heat exchanger 26*a* and a use side heat exchanger 26*b* in FIG. 5. Furthermore, in FIG. 5, pipings indicated by thick lines correspond to pipings through which the refrigerants (the heat source side refrigerant and the heat transfer medium) flow. In addition, the direction of flow of the heat source side refrigerant is indicated by solid-line arrows and the direction of flow of the heat transfer medium is indicated by broken-line arrows in FIG. 5.

In the cooling only operation mode illustrated in FIG. 5, in the outdoor unit 1, a first refrigerant flow switching device 11 is switched such that the heat source side refrigerant discharged from a compressor 10 flows into a heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are fully closed such that the heat transfer medium circulates between each of the heat exchanger related to heat transfer medium 15*a* and the heat exchanger related to heat transfer medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed into a high-pressure liquid refrigerant while transferring heat to outdoor air in the heat source side heat exchanger 12. The high-pressure liquid refrigerant flowing out of the heat source side heat exchanger 12 passes through a check valve 13*a*, flows out of the outdoor unit 1, passes through the refrigerant piping 4, and flows into the heat transfer medium relay unit 3. The high-pressure liquid refrigerant flowing into the heat transfer medium relay unit 3 is branched after passing through an on-off device 17*a* and is expanded into a low-temperature low-pressure two-phase refrigerant by an expansion device 16*a* and an expansion device 16*b*.

This two-phase refrigerant flows into each of the heat exchanger related to heat transfer medium 15*a* and the heat exchanger related to heat transfer medium 15*b*, functioning as evaporators, removes heat from the heat transfer medium circulating in a heat transfer medium circuit B to cool the heat transfer medium, and thus turns into a low-temperature low-pressure gas refrigerant. The gas refrigerant, which has flowed out of each of the heat exchanger related to heat transfer medium 15*a* and the heat exchanger related to heat transfer medium 15*b*, flows out of the heat transfer medium relay unit 3 through the corresponding one of a second refrigerant flow switching device 18*a* and a second refrigerant flow switching device 18*b*, passes through the refrigerant piping 4, and again flows into the outdoor unit 1. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, the superheat being obtained as the difference between a temperature detected by a third temperature sensor 35*c* and that detected by a third temperature sensor 35*d*. Additionally, the on-off device 17*a* is opened and the on-off device 17*b* is closed.

Next, the flow of the heat transfer medium in the heat medium circuit B will be described.

In the cooling only operation mode, both the heat exchanger related to heat transfer medium 15*a* and the heat exchanger related to heat transfer medium 15*b* transfer cooling energy of the heat source side refrigerant to the heat transfer medium, and the pump 21*a* and the pump 21*b* allow the cooled heat transfer medium to flow through the pipings 5. The heat transfer medium, which has flowed out of each of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*. The heat transfer medium removes heat from the indoor air in each of the use side heat exchanger 26*a* and the use side heat exchanger 26*b*, thus cooling the indoor space 7.

The heat transfer medium then flows out of the use side heat exchanger 26*a* and the use side heat exchanger 26*b* and flows into the heat transfer medium flow control device 25*a* and the heat transfer medium flow control device 25*b*, respectively. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has flowed out of the heat transfer medium flow control device 25*a* and the heat transfer medium flow control device 25*b*, passes through the first heat medium flow switching device 22*a* and the first heat transfer medium flow switching device 22*b*, flows into the heat exchanger related to heat transfer medium 15*a* and the heat exchanger related to heat transfer medium 15*b*, and is again sucked into the pump 21*a* and the pump 21*b*.

Note that in the pipes 5 of each use side heat exchanger 26, the heat transfer medium is directed to flow from the second heat transfer medium flow switching device 23 through the heat transfer medium flow control device 25 to the first heat transfer medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat transfer medium 15, either of the temperature detected by the first temperature sensor 31*a* or that detected by the first temperature sensor 31*b* may be used. Alternatively, the mean temperature of the two may be used. At this time, the opening degree of each of the first heat transfer medium flow switching devices 22 and the second heat transfer medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the corresponding use side heat exchanger 26. In FIG. 5, the heat transfer medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Heating Only Operation Mode]

Figure 6:
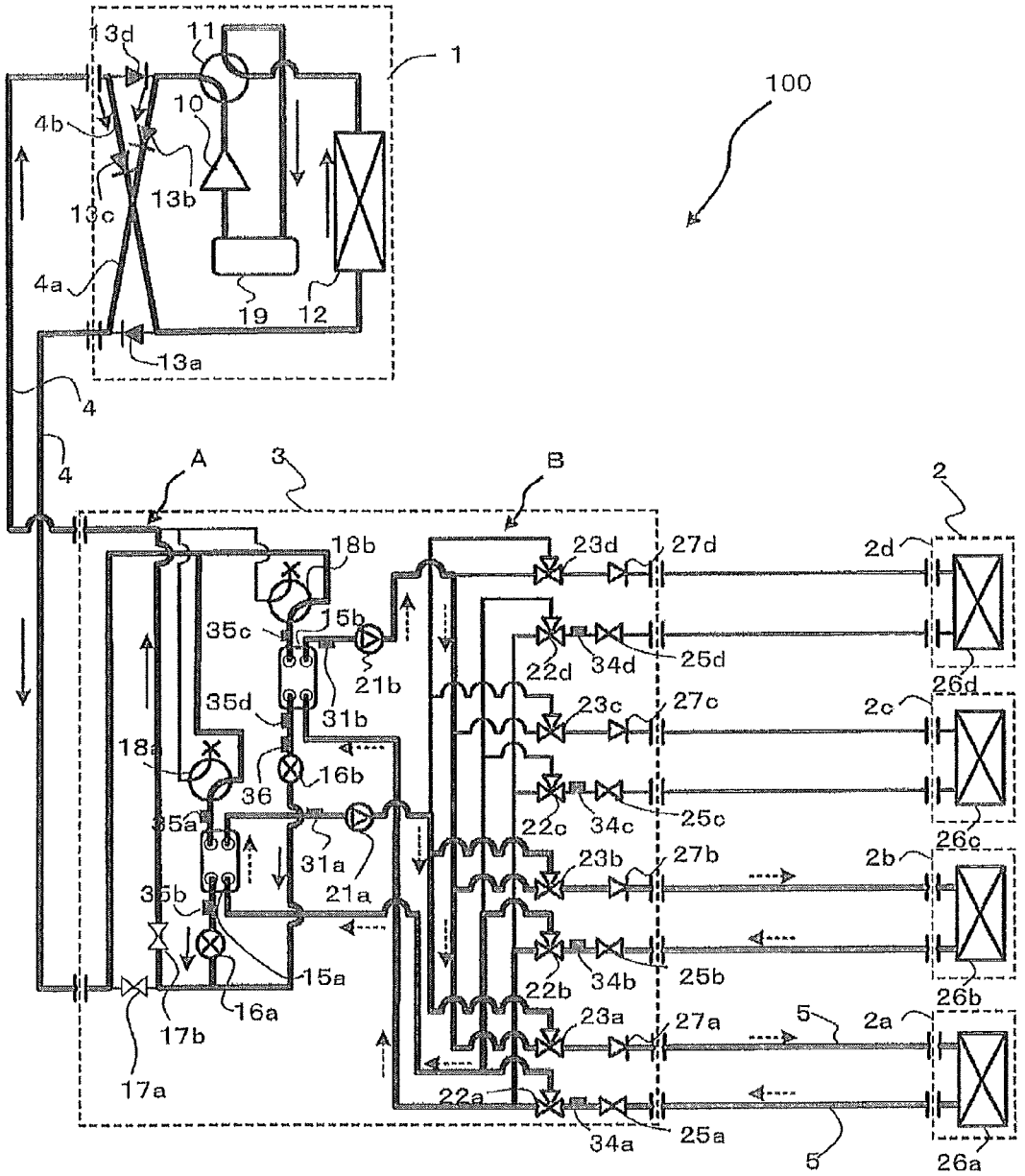
FIG. 6 is a refrigerant circuit diagram illustrating flows of refrigerants in a heating only operation mode of the air-conditioning apparatus according to Embodiment of the invention.

FIG. 6 is a refrigerant circuit diagram illustrating the flows of refrigerants in the heating only operation mode of the air-conditioning apparatus 100. The cooling only operation mode will be described with respect to a case in which a heating load is generated only in a use side heat exchanger 26*a* and a use side heat exchanger 26*b* in FIG. 6. Furthermore, in FIG. 6, pipes indicated by thick lines correspond to pipings through which the refrigerants (the heat source side refrigerant and the heat transfer medium) flow. In addition, the direction of flow of the heat source side refrigerant is indicated by solid-line arrows and the direction of flow of the heat transfer medium is indicated by broken-line arrows in FIG. 6.

In the heating only operation mode illustrated in FIG. 6, in the outdoor unit 1, the first refrigerant flow switching device 11 is switched such that the heat source side refrigerant discharged from the compressor 10 flows into the heat transfer medium relay unit 3 without passing through the heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are fully closed such that the heat transfer medium circulates between each of the heat exchanger related to heat transfer medium 15*a* and the heat exchanger related to heat transfer medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant, which has flowed out of the outdoor unit 1, passes through the refrigerant piping 4 and flows into the heat transfer medium relay unit 3. The high-temperature high-pressure gas refrigerant that has flowed into to heat transfer medium relay unit 3 is branched, passes through each of the second refrigerant flow switching device 18*a* and the second refrigerant flow switching device 18*b*, and flows into the corresponding one of the heat exchanger related to heat transfer medium 15*a* and the heat exchanger related to heat transfer medium 15*b*.

The high-temperature high-pressure gas refrigerant flowing into each of the heat exchanger related to heat transfer medium 15*a* and the heat exchanger related to heat transfer medium 15*b* is condensed into a high-pressure liquid refrigerant while transferring heat to the heat transfer medium circulating in the heat transfer medium circuit B. The liquid refrigerant flowing out of the heat exchanger related to heat transfer medium 15*a* and that flowing out of the heat exchanger related to heat transfer medium 15*b* are expanded into a low-temperature low-pressure, two-phase refrigerant through the expansion device 16*a* and the expansion device 16*b*. This two-phase refrigerant passes through the on-off device 17*b*, flows out of the heat transfer medium relay unit 3, passes through the refrigerant piping 4, and again flows into the outdoor unit 1. The refrigerant flowing into the outdoor unit 1 flows through the second connecting piping 4*b*, passes through the check valve 13*c*, and flows into the heat source side heat exchanger 12, functioning as an evaporator.

Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, the subcooling being obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat transfer medium 15 can be measured, the temperature at the middle position may be used instead of the pressure sensor 36. Accordingly, the system can be constructed inexpensively.

Next, the flow of the heat transfer medium in the heat transfer medium circuit B will be described.

In the heating only operation mode, both of the heat exchanger related to heat transfer medium 15*a* and the heat exchanger related to heat transfer medium 15*b* transfer heating energy of the heat source side refrigerant to the heat transfer medium, and the pump 21*a* and the pump 21*b* allow the heated heat transfer medium to flow through the pipes 5. The heat transfer medium, which has flowed out of each of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*. Then the heat transfer medium transfers heat to the indoor air through each of the use side heat exchanger 26*a* and the use side heat exchanger 26*b*, thus heating the indoor space 7.

The heat transfer medium then flows out of the use side heat exchanger 26*a* and the use side heat exchanger 26*b* and flows into the heat transfer medium flow control device 25*a* and the heat transfer medium flow control device 25*b*, respectively. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has flowed out of the heat transfer medium flow control device 25*a* and the heat transfer medium flow control device 25*b*, passes through the first heat transfer medium flow switching device 22*a* and the first heat transfer medium flow switching device 22*b*, flows into the heat exchanger related to heat transfer medium 15*a* and the heat exchanger related to heat transfer medium 15*b*, and is again sucked into the pump 21*a* and the pump 21*b*.

Note that in the pipings 5 of each use side heat exchanger 26, the heat transfer medium is directed to flow from the second heat transfer medium flow switching device 23 through the heat transfer medium flow control device 25 to the first heat transfer medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat transfer medium flow switching devices 22 and the second heat transfer medium flow switching devices 23 are set to a medium degree such that passages to both of the heat exchanger related to heat transfer medium 15*a* and the heat exchanger related to heat transfer medium 15*b* are established. Although the use side heat exchanger 26*a* should essentially be controlled on the basis of the difference between a temperature at its inlet and that at its outlet, since the temperature of the heat transfer medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the corresponding use side heat exchanger 26. In FIG. 6, the heat transfer medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Cooling Main Operation Mode]

Figure 7:
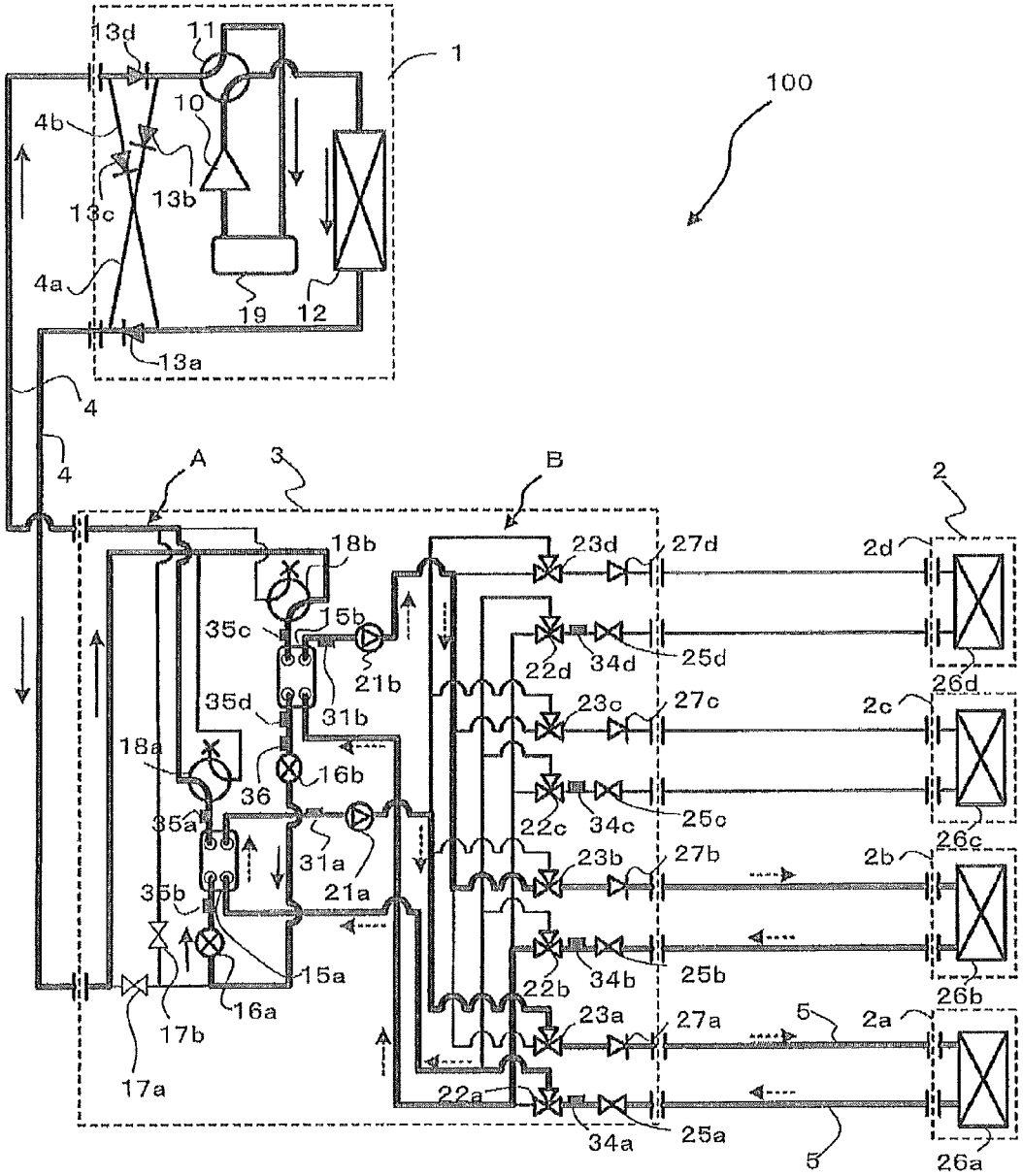
FIG. 7 is a refrigerant circuit diagram illustrating flows of refrigerants in a cooling main operation mode of the air-conditioning apparatus according to Embodiment of the invention.

FIG. 7 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b*. Furthermore, in FIG. 7, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7.

In the cooling main operation mode illustrated in FIG. 7, in the outdoor unit 1, the first refrigerant flow switching device 11 is switched such that the heat source side refrigerant discharged from the compressor 10 flows into the heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are fully closed such that the heat transfer medium circulates between the heat exchanger related to heat transfer medium 15*a* and the use side heat exchanger 26*a*, and between the heat exchanger related to heat transfer medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant piping 4, and flows into the heat transfer medium relay unit 3. The two-phase refrigerant flowing into the heat transfer medium relay unit 3 passes through the second refrigerant flow switching device 18*b* and flows into the heat exchanger related to heat transfer medium 15*b*, functioning as a condenser.

The two-phase refrigerant that has flowed into the heat exchanger related to heat transfer medium 15*b* is condensed and liquefied while transferring heat to the heat transfer medium circulating in the heat transfer medium circuit B, and turns into a liquid refrigerant. The liquid refrigerant flowing out of the heat exchanger related to heat transfer medium 15*b* is expanded into a low-pressure two-phase refrigerant by the expansion device 16*b*. This low-pressure two-phase refrigerant flows through the expansion device 16*a* into the heat exchanger related to heat transfer medium 15*a*, functioning as an evaporator. The low-pressure two-phase refrigerant flowing into the heat exchanger related to heat transfer medium 15*a* removes heat from the heat medium circulating in the heat transfer medium circuit B to cool the heat transfer medium, and thus turns into a low-pressure gas refrigerant. The gas refrigerant flows out of the heat exchanger related to heat transfer medium 15*a*, passes through the second refrigerant flow switching device 18*a*, flows out of the heat transfer medium relay unit 3, and flows into the outdoor unit 1 again through the refrigerant piping 4. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. In addition, the opening degree of the expansion device 16*b* may be controlled such that subcooling is constant, the subcooling being obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat transfer medium in the heat medium circuit B will be described.

In the cooling main operation mode, the heat exchanger related to heat transfer medium 15*b* transfers heating energy of the heat source side refrigerant to the heat transfer medium, and the pump 21*b* allows the heated heat transfer medium to flow through the pipes 5. Furthermore, in the cooling main operation mode, the heat exchanger related to heat transfer medium 15*a* transfers cooling energy of the heat source side refrigerant to the heat transfer medium, and the pump 21*a* allows the cooled heat transfer medium to flow through the pipes 5. The heat transfer medium, which has flowed out of each of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*.

In the use side heat exchanger 26*b*, the heat transfer medium transfers heat to the indoor air, thus heating the indoor space 7. In addition, in the use side heat exchanger 26*a*, the heat transfer medium removes heat from the indoor air, thus cooling the indoor space 7. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has passed through the use side heat exchanger 26*b* with a slight decrease of temperature, passes through the heat transfer medium flow control device 25*b* and the first heat transfer medium flow switching device 22*b*, flows into the heat exchanger related to heat transfer medium 15*b*, and is again sucked into the pump 21*b*. The heat transfer medium, which has passed through the use side heat exchanger 26*a* with a slight increase of temperature, passes through the heat transfer medium flow control device 25*a* and the first heat transfer medium flow switching device 22*a*, flows into the heat exchanger related to heat transfer medium 15*a*, and is then again sucked into the pump 21*a*.

During this time, the function of the first heat transfer medium flow switching devices 22 and the second heat transfer medium flow switching devices 23 allow the heated heat transfer medium and the cooled heat transfer medium to be introduced into the respective use side heat exchangers 26 having a heating load and a cooling load, without being mixed. Note that in the pipes 5 of each of the use side heat exchanger 26 for heating and that for cooling, the heat transfer medium is directed to flow from the second heat transfer medium flow switching device 23 through the heat transfer medium flow control device 25 to the first heat transfer medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the corresponding use side heat exchanger 26. In FIG. 7, the heat transfer medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat transfer medium is circulated.

[Heating Main Operation Mode]

Figure 8:
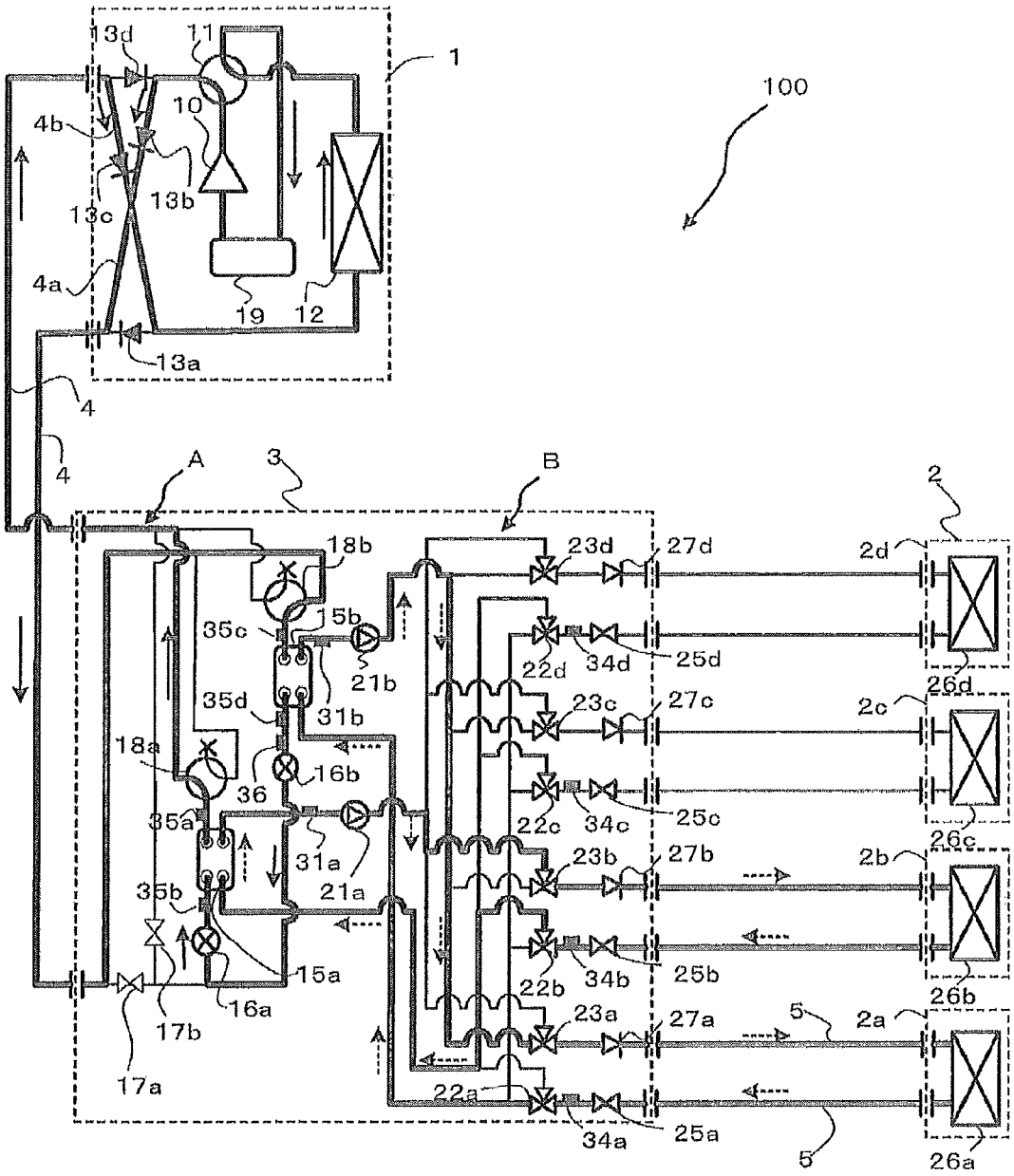
FIG. 8 is a refrigerant circuit diagram illustrating flows of refrigerants in a heating main operation mode of the air-conditioning apparatus according to Embodiment of the invention.

FIG. 8 is a refrigerant circuit diagram illustrating the flows of the refrigerants in the heating main operation mode of the air-conditioning apparatus 100. The heating main operation mode will be described herein with respect to a case in which a heating load is generated in the use side heat exchanger 26*a* and a cooling load is generated in the use side heat exchanger 26*b*. Furthermore, in FIG. 8, pipes indicated by thick lines correspond to pipes through which the refrigerants (the heat source side refrigerant and the heat transfer medium) circulate. In addition, the direction of flow of the heat source side refrigerant is indicated by solid-line arrows and the direction of flow of the heat transfer medium is indicated by broken-line arrows in FIG. 8.

In the heating main operation mode illustrated in FIG. 8, in the outdoor unit 1, the first refrigerant flow switching device 11 is switched such that the heat source side refrigerant discharged from the compressor 10 flows into the heat transfer medium relay unit 3 without passing through the heat source side heat exchanger 12. In the heat transfer medium relay unit 3, the pump 21*a* and the pump 21*b* are driven, the heat transfer medium flow control device 25*a* and the heat transfer medium flow control device 25*b* are opened, and the heat transfer medium flow control device 25*c* and the heat transfer medium flow control device 25*d* are fully closed such that the heat transfer medium circulates between each of the heat exchanger related to heat transfer medium 15*a* and the heat exchanger related to heat transfer medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant, which has flowed out of the outdoor unit 1, passes through the refrigerant piping 4 and flows into the heat transfer medium relay unit 3. The high-temperature high-pressure gas refrigerant flowing into the heat transfer medium relay unit 3 passes through the second refrigerant flow switching device 18*b* and flows into the heat exchanger related to heat transfer medium 15*b*, functioning as a condenser.

The gas refrigerant that has flowed into the heat exchanger related to heat transfer medium 15*b* is condensed and liquefied while transferring heat to the heat transfer medium circulating in the heat transfer medium circuit B, and turns into a liquid refrigerant. The liquid refrigerant flowing out of the heat exchanger related to heat transfer medium 15*b* is expanded into a low-pressure two-phase refrigerant by the expansion device 16*b*. This low-pressure two-phase refrigerant flows through the expansion device 16*a* into the heat exchanger related to heat transfer medium 15*a*, functioning as an evaporator. The low-pressure two-phase refrigerant flowing into the heat exchanger related to heat transfer medium 15*a* removes heat from the heat transfer medium circulating in the heat transfer medium circuit B to evaporate, thus cooling the heat transfer medium. This low-pressure two-phase refrigerant flows out of the heat exchanger related to heat transfer medium 15*a*, passes through the second refrigerant flow switching device 18*a*, flows out of the heat transfer medium relay unit 3, passes through the refrigerant piping 4, and again flows into the outdoor unit 1.

The refrigerant flowing into the outdoor unit 1 passes through the check valve 13*c* and flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is again sucked into the compressor 10.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat transfer medium in the heat transfer medium circuit B will be described.

In the heating main operation mode, the heat exchanger related to heat medium 15*b* transfers heating energy of the heat source side refrigerant to the heat transfer medium, and the pump 21*b* allows the heated heat transfer medium to flow through the pipes 5. Furthermore, in the heating main operation mode, the heat exchanger related to heat transfer medium 15*a* transfers cooling energy of the heat source side refrigerant to the heat transfer medium, and the pump 21*a* allows the cooled heat transfer medium to flow through the pipings 5. The heat transfer medium, which has flowed out of each of the pump 21*a* and the pump 21*b* while being pressurized, flows through the second heat transfer medium flow switching device 23*a* and the second heat transfer medium flow switching device 23*b* into the use side heat exchanger 26*a* and the use side heat exchanger 26*b*.

In the use side heat exchanger 26*b*, the heat transfer medium removes heat from the indoor air, thus cooling the indoor space 7. In addition, in the use side heat exchanger 26*a*, the heat transfer medium transfers heat to the indoor air, thus heating the indoor space 7. At this time, the function of each of the heat transfer medium flow control device 25*a* and the heat transfer medium flow control device 25*b* allows the heat transfer medium to flow into the corresponding one of the use side heat exchanger 26*a* and the use side heat exchanger 26*b* while controlling the heat transfer medium to a flow rate sufficient to cover an air conditioning load required in the indoor space. The heat transfer medium, which has passed through the use side heat exchanger 26*b* with a slight increase of temperature, passes through the heat transfer medium flow control device 25*b* and the first heat transfer medium flow switching device 22*b*, flows into the heat exchanger related to heat transfer medium 15*a*, and is again sucked into the pump 21*a*. The heat transfer medium, which has passed through the use side heat exchanger 26*a* with a slight decrease of temperature, passes through the heat transfer medium flow control device 25*a* and the first heat transfer medium flow switching device 22*a*, flows into the heat exchanger related to heat transfer medium 15*b*, and is again sucked into the pump 21*b*.

During this time, the function of the first heat transfer medium flow switching devices 22 and the second heat transfer medium flow switching devices 23 allow the heated heat transfer medium and the cooled heat transfer medium to be introduced into the respective use side heat exchangers 26 having a heating load and a cooling load, without being mixed. Note that in the pipes 5 of each of the use side heat exchanger 26 for heating and that for cooling, the heat transfer medium is directed to flow from the second heat transfer medium flow switching device 23 through the heat transfer medium flow control device 25 to the first heat transfer medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat transfer medium to each use side heat exchanger 26 having no heat load (including thermo-off), the passage is closed by the corresponding heat transfer medium flow control device 25 such that the heat transfer medium does not flow into the corresponding use side heat exchanger 26. In FIG. 8, the heat transfer medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat transfer medium flow control devices 25*c* and 25*d* are fully closed. When a heat load is generated in the use side heat exchanger 26*c* or the use side heat exchanger 26*d*, the heat transfer medium flow control device 25*c* or the heat transfer medium flow control device 25*d* may be opened such that the heat medium is circulated.

[Refrigerant Piping 4]

As described above, the air-conditioning apparatus 100 according to Embodiment has several operation modes. In these operation modes, the heat source side refrigerant flows through the refrigerant pipes 4 connecting the outdoor unit 1 and the heat medium relay unit 3.

[Piping 5]

In some operation modes carried out by the air-conditioning apparatus 100 according to Embodiment, the heat transfer medium, such as water or antifreeze, flows through the pipes 5 connecting the heat transfer medium relay unit 3 and the indoor units 2.

[Heat Medium Backflow Prevention Device 27]

Here, the heat transfer medium backflow prevention device 27 will be described in detail. As shown in FIGS. 3 to 8, the air-conditioning apparatus 100 includes a heat transfer medium backflow prevention device 27 that prevents the heat transfer medium from backflowing. As described in the operation mode carried out by the air-conditioning apparatus 100, the flow direction of the heat transfer medium flowing in the pipes 5 is the same irrespective of the operation mode. That is to say, the heat transfer medium flowing in the pipes 5 is allowed to flow out from the heat transfer medium relay unit 3 to the indoor units 2 through the second heat transfer medium flow switching devices 23, to pass through the use side heat exchangers 26, to flow from the indoor units 2 into the heat transfer medium relay unit 3, and to return to the heat exchangers related to heat transfer medium 15 through the heat transfer medium flow control devices 25 and the first heat transfer medium flow switching devices 22.

Accordingly, even when each heat transfer medium backflow prevention device 27 is disposed in each piping 5 where the refrigerant flows in the direction from the second heat transfer medium flow switching device 23 to the indoor unit 2 (each piping 5 on the inlet side of the heat transfer medium of the indoor unit 2), no problem will occur during normal operation of the air-conditioning apparatus 100.

On the other hand, as regards the heat medium flow control device 25 that is disposed in the piping 5 on the outlet side of the heat transfer medium of the indoor unit 2, a two-way valve that is capable of closing a passage will be easy to handle, but not limited to this, the flow rate may be controlled with a three-way valve used as a two-way valve by closing one of the ports, or a three way valve having a passage closing function bypassing the use side heat exchanger 26.

As regards the connection method of connecting an actuator, such as a valve, to a piping, there are a few methods, such as the flare method, the Swagelok method, the quick fastener method, the screw-in method, and the brazing method. However, since on the market valves are purchased when valves for heat transfer medium, such as water, are used, the brazing method is not employed much as the connection method. The connection methods other than the brazing method, for example, prevent water from leaking by using an O-ring or prevent water from leaking with the tightening torque of a screw of a connector. However, due to the degradation of the O-ring or insufficient tightening torque, or due to the loosening of the screw attributed to the shaking of the piping while in use, heat transfer medium is assumed to leak out from the connection.

Accordingly, in the air-conditioning apparatus 100, a drain pan 38 is disposed in the bottom portion of the heat transfer medium relay unit 3 in order to store temporarily the leaking heat transfer medium and to discharge the heat transfer medium to the outside from a discharge port provided in the drain pan 38. The piping and each connection of the actuator are disposed in a position above the drain pan 38. In addition, this drain pan 38 has a function of stopping dew, which has condensed on the heat exchanger related to heat transfer medium 15*a*, the heat exchanger related to heat transfer medium 15*b*, the refrigerant pipes 4, and the pipes 5 when the heat exchanger related to heat transfer medium 15*a* and the heat exchanger related to heat transfer medium 15*b* are functioning as evaporators, from leaking out. However, assuming that the pipes 5 that connect the heat transfer medium relay unit 3 and the indoor units 2 may be a few ten meters long and that the heat transfer medium in the pipes 5 will be stored in the drain pan 38, a substantially large drain pan 38 will be required. Hence, it will be costly and a considerably large space will be needed.

Therefore, in the air-conditioning apparatus 100, each heat transfer medium flow control device 25 is disposed on the outlet side of each indoor unit 2, which is the passage from the indoor unit 2 to the heat transfer medium flow switching device 23, and each heat transfer medium backflow prevention device 27 is disposed on the inlet side of each indoor unit 2, which is a passage from the second heat transfer medium flow switching device 23 to the indoor unit 2. When a leakage of the heat transfer medium from the connector of each actuator is detected, the heat transfer medium flow control device 25 is controlled to close the passage of the heat transfer medium.

With the above control, even if the pressure in the piping 5 in the heat transfer medium relay unit 3 drops due to leakage of the heat transfer medium, owing to the function of the heat transfer medium flow control device 25 and the heat transfer medium backflow prevention device 27, the heat transfer medium from the heat transfer medium flow control device 25 to the heat transfer medium backflow prevention device 27 through the use side heat exchanger 26 is preserved in the piping 5 without backflowing towards the heat transfer medium relay unit 3. Hence, only the heat transfer medium that is filled in the heat transfer medium relay unit 3 is stored in the drain pan (not illustrated) that is disposed in the bottom portion of the heat transfer medium relay unit 3.

Accordingly, by making the water retaining capacity (water retaining volume) of the drain pan 38 be larger than the inner volume of the pipes in the heat transfer medium relay unit 3, then even if the entire heat transfer medium in the heat transfer medium relay unit 3 leaks out, there will be no heat transfer medium leaking out of the drain pan 38. Thus, a safe system is obtained.

When a leakage of the heat transfer medium from the connector of each actuator is detected, by controlling the second heat transfer medium flow switching devices 23 and the first heat transfer medium flow switching devices 22 to direct the heat transfer medium to either the heat exchanger related to heat transfer medium 15*a* or the heat exchanger related to heat transfer medium 15*b*, the entire passages of the heat exchanger related to heat transfer medium 15*a* and the heat exchanger related to heat transfer medium 15*b* can be avoided from being connected, and, thus, the amount of heat transfer medium leaking from the heat transfer medium relay unit 3 into the drain pan 38 can be half the amount of the total amount of the heat transfer medium.

Here, although description is made in a case in which a check valve is used as the heat transfer medium backflow prevention device 27, it does not have to be a check valve as long as the passage can be closed. A device such as a two-way valve may be used. In a case in which a two-way valve is used as the heat transfer medium backflow prevention device 27, the heat transfer medium flow control device 25 may be disposed in a passage on the inlet side of the use side heat exchanger 26 and the heat transfer medium backflow prevention device 27 may be disposed in the passage on the outlet side of the use side heat exchanger 26. In either case, the same advantages can be obtained.

When heat transfer medium leaks, there will be air entering into the piping 5 from the outside. Accordingly, there will be heat transfer medium with air mixed therein sucked into the suction sides of the pump 21*a* and pump 21*b*. When the pump 21 sucks in the heat transfer medium with air mixed therein, compared to normal times, the pump characteristics changes and the rotation speed changes. By detecting this change in rotation speed, leakage of heat transfer medium from the piping 5 can be detected. There are other ways to detect the leakage of heat transfer medium. The leakage of the heat transfer medium can be detected by, for example, detecting the pressure in the piping 5 and monitoring its change. The heat transfer medium leakage detecting function that detects leakage of heat transfer medium from the heat transfer medium circuit B may be configured by one of these methods.

Although the heat transfer medium backflow prevention device 27 may be disposed on either the upstream side or the downstream side of the first heat transfer medium flow switching device 22, if it is disposed between the use side heat exchanger 26 and the first heat transfer medium flow switching device 22, then only a single heat transfer medium backflow prevention device 27 will be required for each use side heat exchanger 26, and, thus, the system can be configured at low cost. It is the same for the heat transfer medium flow control device 25, and if it is disposed between the use side heat exchanger 26 and the second heat transfer medium flow switching device 23, then only a heat transfer medium flow control device 25 will be required for each use side heat exchanger 26, and, thus, the system can be configured at low cost.

It is preferable that the heat transfer medium backflow prevention device 27 and the heat transfer medium flow control device 25 are disposed in the heat medium relay unit 3, but even if not equipped in the heat transfer medium relay unit 3, if it is disposed near the heat transfer medium relay unit 3, then the amount of heat transfer medium leaking into the drain pan 38 can be reduced.

Furthermore, in the air-conditioning apparatus 100, in the case in which only the heating load or cooling load is generated in the use side heat exchangers 26, the corresponding first heat transfer medium flow switching devices 22 and the corresponding second heat transfer medium flow switching devices 23 are controlled so as to have a medium opening degree, such that the heat transfer medium flows into both of the heat exchanger related to heat medium 15*a* and the heat exchanger related to heat transfer medium 15*b*. Consequently, since both the heat exchanger related to heat transfer medium 15*a* and the heat exchanger related to heat transfer medium 15*b* can be Used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat transfer medium flow switching device 22 and the second heat transfer medium flow switching device 23 corresponding to the use side heat exchanger 26 which performs the heating operation are switched to the passage connected to the heat exchanger related to heat transfer medium 15*b* for heating, and the first heat transfer medium flow switching device 22 and the second heat transfer medium flow switching device 23 corresponding to the use side heat exchanger 26 which performs the cooling operation are switched to the passage connected to the heat exchanger related to heat transfer medium 15*a* for cooling, so that the heating operation or cooling operation can be freely performed in each indoor unit 2.

Furthermore, each of the first heat transfer medium flow switching devices 22 and the second heat transfer medium flow switching devices 23 described in Embodiment may be any of the sort as long as they can switch passages, for example, a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat transfer medium flow switching devices 22 and the second heat transfer medium flow switching devices 23. In this case, water hammer caused when a passage is suddenly opened or closed can be prevented. Furthermore, while Embodiment has been described with respect to the case in which the heat transfer medium flow control devices 25 each include a two-way valve, each of the heat transfer medium flow control devices 25 may include a control valve having three passages and the valve may be disposed with a bypass piping that bypasses the corresponding use side heat exchanger 26.

Furthermore, as regards each of the heat transfer medium flow control device 25, a stepping-motor-driven type that is capable of controlling a flow rate in the passage is preferably used. Alternatively, a two-way valve or a three-way valve whose one end is closed may be used. Alternatively, as regards each of the heat medium flow control device 25, a component, such as an on-off valve, which is capable of opening or closing a two-way passage, may be used while ON and OFF operations are repeated to control an average flow rate.

Furthermore, while each second refrigerant flow switching device 18 has been described as if it is a four-way valve, the device is not limited to this type. The device may be configured such that the refrigerant flows in the same manner using a plurality of two-way flow switching valves or three-way flow switching valves.

While the air-conditioning apparatus 100 according to Embodiment has been described with respect to the case in which the apparatus can perform the cooling and heating mixed operation, the apparatus is not limited to the case. Even with an apparatus that is configured with a single heat exchanger related to heat transfer medium 15 and a single expansion device 16 that are connected to a plurality of parallel use side heat exchangers 26 and heat transfer medium flow control devices 25, and is capable of carrying out only a cooling operation or a heating operation, the same advantages can be obtained.

In addition, it is needless to say that the same holds true for the case in which only a single use side heat exchanger 26 and a single heat transfer medium flow control device 25 are connected. Moreover, obviously, no problem will arise even if the heat exchanger related to heat transfer medium 15 and the expansion device 16 acting in the same manner are arranged in plural numbers. Furthermore, while the case in which the heat transfer medium flow control devices 25 are equipped in the heat transfer medium relay unit 3 has been described, the arrangement is not limited to this case. Each heat transfer medium flow control device 25 may be disposed in the indoor unit 2. The heat transfer medium relay unit 3 may be separated from the indoor unit 2.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as $CO_2$ or propane, can be used. While the heat exchanger related to heat medium 15*a* or the heat exchanger related to heat transfer medium 15*b* is operating for heating, a refrigerant that typically changes between two phases is condensed and liquefied and a refrigerant that turns into a supercritical state, such as $CO_2$, is cooled in the supercritical state. As for the rest, either of the refrigerant acts in the same manner and offers the same advantages.

As regards the heat transfer medium, for example, brine (antifreeze), water, a mixed solution of brine and water, or a mixed solution of water and an additive with high anticorrosive effect can be used. In the air-conditioning apparatus 100, therefore, even if the heat transfer medium leaks into the indoor space 7 through the indoor unit 2, because the heat transfer medium used is highly safe, contribution to improvement of safety can be made.

While Embodiment has been described with respect to the case in which the air-conditioning apparatus 100 includes the accumulator 19, the accumulator 19 may be omitted. Typically, a heat source side heat exchanger 12 and a use side heat exchanger 26 are provided with an blower in which a current of air often facilitates condensation or evaporation. The structure is not limited to this case. For example, a heat exchanger, such as a panel heater, using radiation can be used as the use side heat exchanger 26 and a water-cooled heat exchanger, which transfers heat using water or antifreeze, can be used as the heat source side heat exchanger 12. In other words, as long as the heat exchanger is configured to be capable of transferring heat or removing heat, any type of heat exchanger can be used as each of the heat source side heat exchanger 12 and the use side heat exchanger 26.

Embodiment has been described in which the number of heat exchangers related to heat transfer medium 26 is two. As a matter of course, the arrangement is not limited to this case. Furthermore, Description has been made illustrating a case in which there are two heat exchangers related to heat transfer medium, namely, heat exchanger related to heat transfer medium 15*a* and heat exchanger related to heat transfer medium 15*b*. As a matter of course, the arrangement is not limited to this case, and as long as it is configured so that cooling and/or heating of the heat transfer medium can be carried out, the number may be any number. Furthermore, each of the number of pumps 21*a* and that of pumps 21*b* is not limited to one. A plurality of pumps having a small capacity may be connected in parallel.

Figure 9:
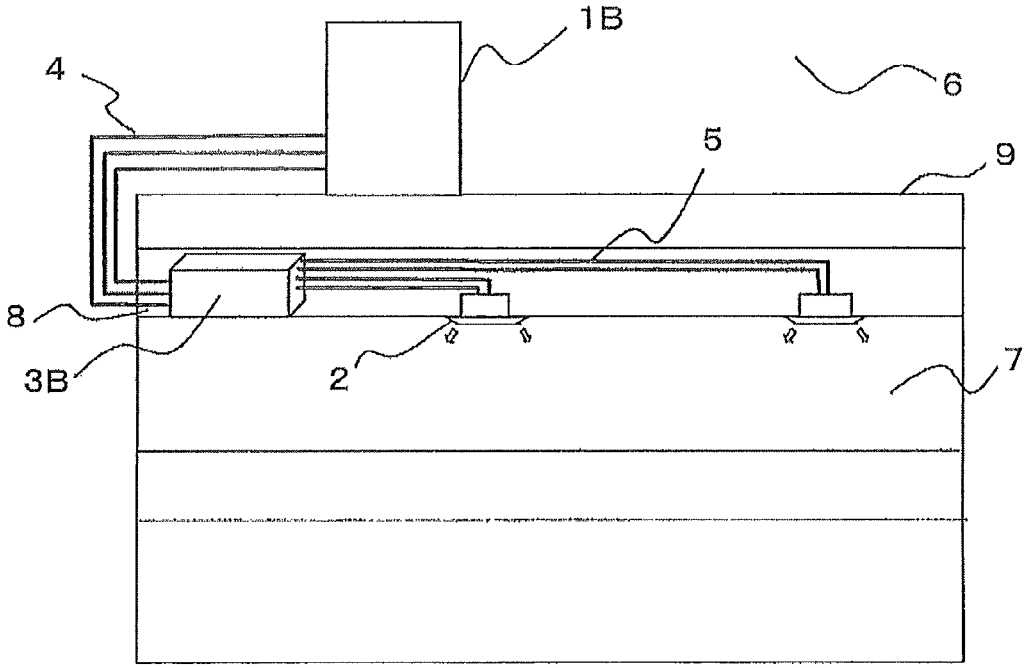
FIG. 9 is a schematic diagram illustrating an exemplary installation of an air-conditioning apparatus according to Embodiment of the invention.
Figure 10:
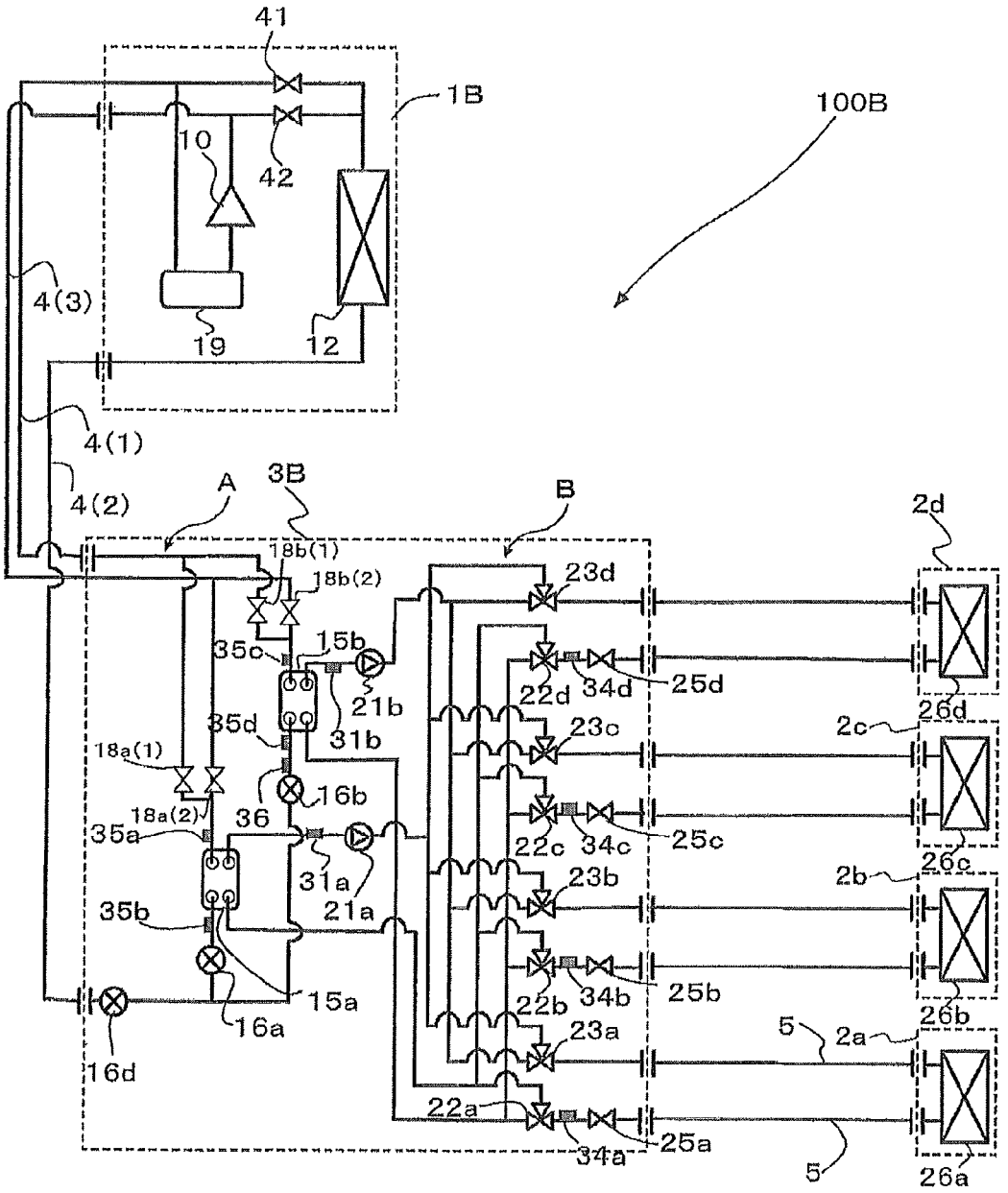
FIG. 10 is another schematic circuit diagram illustrating an exemplary circuit configuration of the air-conditioning apparatus according to Embodiment of the invention.

Note that the air-conditioning apparatus according to Embodiment (hereinafter referred as air-conditioning apparatus 100B) may be configured such that the outdoor unit (hereinafter, referred as outdoor unit 1B) and the heat transfer medium relay unit (hereinafter, referred as heat transfer medium relay unit 3B) are connected with three refrigerant pipes 4 (refrigerant piping 4(1), refrigerant piping 4(2), refrigerant piping 4(3)) as shown in FIG. 10. FIG. 9 illustrates a diagram of an exemplary installation of the air-conditioning apparatus 100B. Specifically, the air-conditioning apparatus 100B also allows all of the indoor units 2 to perform the same operation and allows each of the indoor units 2 to perform different operations. In addition, in the refrigerant piping 4(2) in the heat transfer medium relay unit 3B, an expansion device 16*b* (for example, an electronic expansion valve) is provided for the merging high-pressure liquid during cooling main operation mode.

The general configuration of the air-conditioning apparatus 100B is the same as the air-conditioning apparatus 100 except for the outdoor unit 1B and the heat transfer medium relay unit 3B. The outdoor unit 1B includes a compressor 10, a heat source side heat exchanger 12, an accumulator 19, two flow switching units (flow switching unit 41 and flow switching unit 42). The flow switching unit 41 and the flow switching unit 42 constitute the first refrigerant flow switching device. In the air-conditioning apparatus 100, a case in which the first refrigerant flow switching device is a four-way valve has been described, but as shown in FIG. 10, the first refrigerant switching device may be a combination of a plurality of two-way valves.

In the heat transfer medium relay unit 3B, the refrigerant piping, which is branched from the refrigerant piping 4(2) having the on-off device 17 and is connected to the second refrigerant switching device 18*b*, is not provided and instead the second refrigerant flow switching device 18*a* (1) and the second refrigerant flow switching device 18*b* (1) are connected to the refrigerant piping 4(1), and the second refrigerant flow switching device 18*a* (2) and the second refrigerant flow switching device 18*b* (2) are connected to the refrigerant piping 4(3). Further, the expansion device 16*d* is provided and is connected to the refrigerant piping 4(2).

The refrigerant piping 4(3) connects the discharge piping of the compressor 10 to the heat transfer medium relay unit 3B. The two flow switching units each include, for example, a two-way valve and are configured to open or close the refrigerant piping 4. The flow switching unit 41 is provided between the suction piping of the compressor 10 and the heat source side heat exchanger 12, and the control of its opening and closing switches the refrigerant flow of the heat source refrigerant. The flow switching unit 42 is provided between the discharge piping of the compressor 10 and the heat source side heat exchanger 12, and the control of its opening and closing switches the refrigerant flow of the heat source refrigerant.

Hereinafter, with reference to FIG. 10, each operation mode carried out by the air-conditioning apparatus 100 B will be described. Note that since the heat transfer medium flow in the heat transfer medium circuit B is the same as the air-conditioning apparatus 100, description will be omitted.

[Cooling Only Operation Mode]

In this cooling only operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the flow switching unit 42 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant, which has flowed out of the heat source side heat exchanger 12, passes through the refrigerant piping 4 (2) and flows into the heat transfer medium relay unit 3B. The high-pressure liquid refrigerant flowing into the heat transfer medium relay unit 3B is branched after passing through a fully opened expansion device 16*d* and is expanded into a low-temperature low-pressure two-phase refrigerant by an expansion device 16*a* and an expansion device 16*b*.

This two-phase refrigerant flows into each of the heat exchanger related to heat transfer medium 15*a* and the heat exchanger related to heat transfer medium 15*b*, functioning as evaporators, removes heat from the heat transfer medium circulating in a heat transfer medium circuit B to cool the heat transfer medium, and thus turns into a low-temperature low-pressure gas refrigerant. The gas refrigerant, which has flowed out of each of the heat exchanger related to heat transfer medium 15*a* and the heat exchanger related to heat transfer medium 15*b*, merges and flows out of the heat transfer medium relay unit 3B through the corresponding one of a second refrigerant flow switching device 18*a* and a second refrigerant flow switching device 18*b*, passes through the refrigerant piping 4 (1), and again flows into the outdoor unit 1. The refrigerant flowing into the outdoor unit 1B, flow through the accumulator 19 and again is sucked into the compressor 10.

[Heating Only Operation Mode]

In this heating only operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the refrigerant piping 4 (3) and out of the outdoor unit 1B. The high-temperature high-pressure gas refrigerant, which has flowed out of the outdoor unit 1B, passes through the refrigerant piping 4 (3) and flows into the heat medium relay unit 3B. The high-temperature high-pressure gas refrigerant that has flowed into to the heat medium relay unit 3B is branched, passes through each of the second refrigerant flow switching device 18*a* and the second refrigerant flow switching device 18*b*, and flows into the corresponding one of the heat exchanger related to heat medium 15*a* and the heat exchanger related to heat transfer medium 15*b*.

The high-temperature high-pressure gas refrigerant flowing into each of the heat exchanger related to heat transfer medium 15*a* and the heat exchanger related to heat transfer medium 15*b* is condensed and liquefied into a high-pressure liquid refrigerant while transferring heat to the heat transfer medium circulating in the heat transfer medium circuit B. The liquid refrigerant flowing out of the heat exchanger related to heat transfer medium 15*a* and that flowing out of the heat exchanger related to heat medium 15*b* are expanded into a low-temperature low-pressure, two-phase refrigerant through the expansion device 16*a* and the expansion device 16*b*. This two-phase refrigerant passes through the fully-opened expansion device 16*d*, flows out of the heat transfer medium relay unit 3B, passes through the refrigerant piping 4 (2), and again flows into the outdoor unit 1B.

The refrigerant flowing into the outdoor unit 1B flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the flow switching unit 41 and the accumulator 19 and is again sucked into the compressor 10.

[Cooling Main Operation Mode]

The cooling main operation mode will be described with respect to a case in which a cooling load is generated in the use side heat exchanger 26*a* and a heating load is generated in the use side heat exchanger 26*b*. Note that in the cooling main operation mode, flow switching unit 41 is closed, and the flow switching unit 42 is opened.

A low-temperature low-pressure refrigerant is compressed by the compressor 10 and is discharged as a high-temperature high-pressure gas refrigerant therefrom. A portion of the high-temperature high-pressure gas refrigerant discharged from the compressor 10 flows through the flow switching unit 42 into the heat source side heat exchanger 12. Then, the refrigerant is condensed into a high-pressure liquid refrigerant while transferring heat to outdoor air in the heat source side heat exchanger 12. The liquid refrigerant, which has flowed out of the heat source side heat exchanger 12, passes through the refrigerant piping 4 (2), flows into the heat transfer medium relay unit 3B, and is slightly decompressed to medium pressure by the expansion device 16*d*. Meanwhile, the remaining high-temperature high-pressure gas refrigerant passes through the refrigerant piping 4 (3) and flows into the heat transfer medium relay unit 3B. The high-temperature high-pressure refrigerant flowing into the heat transfer medium relay unit 3B passes through the second refrigerant flow switching device 18*b*(2) and flows into the heat exchanger related to heat transfer medium 15*b*, functioning as a condenser.

The high-temperature high-pressure gas refrigerant that has flowed into the heat transfer medium heat exchanger 15*b* is condensed and liquefied while transferring heat to the heat transfer medium circulating in the heat transfer medium circulating circuit B, and turns into a liquid refrigerant. The liquid refrigerant flowing out of the heat exchanger related to heat transfer medium 15*b* is slightly decompressed to medium pressure by the expansion device 16*b* and is merged with the liquid refrigerant that has been decompressed to medium pressure by the expansion device 16*d*. The merged refrigerant is expanded by the expansion device 16*a* turning into a low-pressure two-phase refrigerant and flows into the heat exchanger related to heat transfer medium 15*a* functioning as an evaporator. The low-pressure two-phase refrigerant flowing into the heat exchanger related to heat transfer medium 15*a* removes heat from the heat transfer medium circulating in the heat transfer medium circuit B to cool the heat medium, and thus turns into a low-pressure gas refrigerant. This gas refrigerant flows out of the heat exchanger related to heat transfer medium 15*a*, flows through the second refrigerant flow switching device 18*a*(1) out of the heat transfer medium relay unit 3, passes through the refrigerant piping 4 (1), and again flows into the outdoor unit 1B. The refrigerant flowing into the outdoor unit 1B, flows through the accumulator 19 and again is sucked into the compressor 10.

[Heating Main Operation Mode]

The heating main operation mode will be described herein with respect to a case in which a heating load is generated in the use side heat exchanger 26*a* and a cooling load is generated in the use side heat exchanger 26*b*. Note that in the heating main operation mode, flow switching unit 41 is opened, and the flow switching unit 42 is closed.

A low-temperature low-pressure refrigerant is compressed by the compressor 10 and is discharged as a high-temperature high-pressure gas refrigerant therefrom. All of the high-temperature high-pressure gas refrigerant discharged from the compressor 10 flows through the refrigerant piping 4 (3) and out of the outdoor unit 1B. The high-temperature high-pressure gas refrigerant, which has flowed out of the outdoor unit 1B, passes through the refrigerant piping 4 (3) and flows into the heat transfer medium relay unit 3B. The high-temperature high-pressure gas refrigerant flowing into the heat transfer medium relay unit 3B passes through the second refrigerant flow switching device 18*b*(2) and flows into the heat exchanger related to heat transfer medium 15*b*, functioning as a condenser.

The gas refrigerant that has flowed into the heat exchanger related to heat transfer medium 15*b* is condensed and liquefied while transferring heat to the heat transfer medium circulating in the heat transfer medium circuit B, and turns into a liquid refrigerant. The liquid refrigerant flowing out of the heat exchanger related to heat transfer medium 15*b* is expanded into a low-pressure two-phase refrigerant by the expansion device 16*b*. This low-pressure two-phase refrigerant is branched into two, and one portion flows through the expansion device 16*a* into the heat exchanger related to heat transfer medium 15*a*, functioning as an evaporator. The low-pressure two-phase refrigerant flowing into the heat exchanger related to heat transfer medium 15*a* removes heat from the heat transfer medium circulating in the heat transfer medium circuit B to evaporate, thus cooling the heat transfer medium. This low-pressure two-phase refrigerant flows out of the heat exchanger related to heat transfer medium 15*a*, turns into a low-temperature low-pressure gas refrigerant, passes through the second refrigerant flow switching device 18*a*(1), flows out of the heat transfer medium relay unit 3B, passes through the refrigerant piping 4(1), and again flows into the outdoor unit 1. The two-phase low-pressure refrigerant, which had been branched after flowing thorough the expansion device 16*b*, passes through the fully-opened expansion device 16*d*, flows out of the heat transfer medium relay unit 3B, passes through the refrigerant piping 4 (2), and flows into the outdoor unit 1B.

The refrigerant flowing through the refrigerant piping 4(2) and into the outdoor unit 1B flows into the heat source side heat exchanger 12, functioning as an evaporator. Then, the refrigerant flowing into the heat source side heat exchanger 12 removes heat from the outdoor air in the heat source side heat exchanger 12 and thus turns into a low-temperature low-pressure gas refrigerant. The low-temperature low-pressure gas refrigerant that has flowed out of the heat source side heat exchanger 12 flows through the flow switching unit 41, merges with the low-temperature low-pressure gas refrigerant that has flowed into the outdoor unit 1B through the refrigerant piping 4(1), flows through the accumulator 19, and again is sucked into the compressor 10.

As described above, the air-conditioning apparatus (the air-conditioning apparatus 100, air-conditioning apparatus 100A, and air-conditioning apparatus 100B) not only increase safety by not allowing the heat source side refrigerant to circulate to or near the indoor units 2, but further increase safety by being able to store the heat transfer medium that has leaked out of the connection of each actuator and the pipes 5 within the heat transfer medium relay unit 3. Furthermore, the pipes 5 can be shortened in the air-conditioning apparatus 100, thus energy saving can be achieved. Still further, the air-conditioning apparatus 100 can reduce the connecting pipes (refrigerant pipes 4 and pipes 5) between the outdoor unit 1 and the heat medium relay unit 3, and between the heat transfer medium relay unit 3 and the indoor units 2, thus increase ease of construction.

REFERENCE SIGNS LIST

1 outdoor unit, 1B outdoor unit, 2 indoor unit, 2*a* indoor unit, 2*b* indoor unit, 2*c* indoor unit, 2*d* indoor unit, 3 heat transfer medium relay unit, 3B heat transfer medium relay unit, 3*a* main heat transfer medium relay unit, 3*b* sub heat transfer medium relay unit, 4 refrigerant piping, 4*a* first connection piping, 4*b* second connection piping, 5 piping, 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 14 gas-liquid separator, 15 heat exchanger related to heat transfer medium, 15*a* heat exchanger related to heat transfer medium, 15*b* heat exchanger related to heat transfer medium, 16 expansion device, 16*a* expansion device, 16*b* expansion device, 16*c* expansion device, 16*d* expansion device, 17 on-off device, 17*a* on-off device, 17*b* on-off device, 18 second refrigerant flow switching device, 18*a* refrigerant flow switching device, 18*b* refrigerant flow switching device, 19 accumulator, 21 pump, 21*a* pump, 21*b* pump, 22 first heat transfer medium flow switching device, 22*a* first heat transfer medium flow switching device, 22*b* first heat transfer medium flow switching device, 22*c* first heat transfer medium flow switching device, 22*d* first heat transfer medium flow switching device, 23 second heat transfer medium flow switching device, 23*a* second heat transfer medium flow switching device, 23*b* second heat transfer medium flow switching device, 23*c* second heat transfer medium flow switching device, 23*d* second heat transfer medium flow switching device, 25 heat transfer medium flow control device, 25*a* heat transfer medium flow control device, 25*b* heat transfer medium flow control device, 25*c* heat transfer medium flow control device, 25*d* heat transfer medium flow control device, 26 use side heat exchanger, 26*a* use side heat exchanger, 26*b* use side heat exchanger, 26*c* use side heat exchanger, 26*d* use side heat exchanger, 27 heat transfer medium backflow prevention device, 27*a* heat transfer medium backflow prevention device, 27*b* heat transfer medium backflow prevention device, 27*c* heat transfer medium backflow prevention device, 27*d* heat transfer medium backflow prevention device, 31 first temperature sensor, 31*a* first temperature sensor, 31*b* first temperature sensor, 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 37 controller, 38 drain pan, 41 flow switching unit, 42 flow switching unit, 100 air-conditioning apparatus, 100A air-conditioning apparatus, 100B air-conditioning apparatus, A refrigerant circuit, B heat transfer medium circuit

The invention claimed is:

1. An air-conditioning apparatus, comprising:

a compressor; a heat source side heat exchanger; a plurality of expansion devices; a plurality of heat exchangers for a heat transfer medium; a pump; and use side heat exchangers, wherein a refrigerant circuit circulating a heat source side refrigerant is formed by connecting the compressor, the heat source side heat exchanger, the plurality of expansion devices, and refrigerant passages of the heat exchangers for the heat transfer medium with refrigerant pipes, a heat transfer medium circuit circulating a heat transfer medium is formed by connecting the pump, the use side heat exchangers, and heat transfer medium passages of the heat exchangers for the heat transfer medium with heat transfer medium pipes, and the heat transfer medium and the heat source side refrigerant exchange heat in the heat exchangers for the heat transfer medium, the air-conditioning apparatus further comprising:

use side heat transfer medium flow control devices each disposed on an outlet side of each of the use side heat exchangers and first heat transfer medium flow switching devices each disposed on the outlet side of each of the use side heat exchangers; and heat transfer medium backflow prevention devices each disposed on an inlet side of each of the use side heat exchangers, wherein the flow direction of the heat transfer medium flowing in the heat transfer medium pipes is the same irrespective of the operation mode, and each of the heat transfer medium backflow prevention devices includes a check valve that prevents the heat transfer medium from backflowing against the flow direction of the heat transfer medium.

2. The air-conditioning apparatus of claim 1, further comprising second heat transfer medium flow switching devices each disposed on the inlet side of each of the use side heat exchangers.

3. The air-conditioning apparatus of claim 2, wherein each use side heat transfer medium flow control device is disposed between each of the use side heat exchangers and the corresponding first heat transfer medium flow switching device, each heat transfer medium backflow prevention device is disposed between each of the use side heat exchangers and the corresponding second heat transfer medium flow switching device.

4. The air-conditioning apparatus of claim 2, wherein a heat transfer medium relay unit houses the expansion devices, the heat exchangers for the heat transfer medium, the first heat transfer medium flow switching devices, and the second heat transfer medium flow switching devices, and the use side heat transfer medium flow control devices and the heat transfer medium backflow prevention devices are disposed in or adjacent to the heat transfer medium relay unit.

5. The air-conditioning apparatus of claim 4, further comprising a drain pan provided in a bottom portion of the heat transfer medium relay unit, the drain pan capable of storing and discharging any heat transfer medium that has leaked from the heat transfer medium circuit.

6. The air-conditioning apparatus of claim 5, wherein the drain pan is provided below the use side heat transfer medium flow control devices, the first heat transfer medium flow switching devices, the second heat transfer medium flow switching devices, and the heat transfer medium backflow prevention devices of the heat transfer medium relay unit.

7. The air-conditioning apparatus of claim 5, wherein the water retaining volume of the drain pan is larger than an inner volume of the heat transfer medium pipes from the use side heat transfer medium flow control devices to the heat transfer medium backflow prevention devices of the heat transfer medium relay unit.

8. The air-conditioning apparatus of claim 1 further comprising:

a heat transfer medium leakage detecting device which detects the leakage of the heat transfer medium from the heat transfer medium circuit, wherein upon detection of a leakage of the heat transfer medium by the heat transfer medium leakage detecting device, the one or more use side heat transfer medium flow control devices are used to close the heat transfer medium circuit.

9. The air-conditioning apparatus of claim 8, wherein upon detection of a leakage of the heat transfer medium by the heat transfer medium leakage detecting device, the second heat transfer medium flow switching devices and the first heat transfer medium flow switching devices are controlled such that the heat transfer medium from the use side heat exchangers is directed to flow to one or more of the heat exchangers for the heat transfer medium.

10. The air-conditioning apparatus of claim 8, wherein the heat transfer medium leakage detecting device is configured such that the leakage of the heat transfer medium from the heat transfer medium circuit is detected when the rotation speed of the pump changes.

* * * * *